US012383802B2

(12) United States Patent
Spackman et al.

(10) Patent No.: US 12,383,802 B2
(45) Date of Patent: Aug. 12, 2025

(54) GOLF CLUB HEAD FACEPLATES WITH LATTICES

(71) Applicant: KARSTEN MANUFACTURING CORPORATION, Phoenix, AZ (US)

(72) Inventors: Clayson C. Spackman, Scottsdale, AZ (US); Matthew W. Simone, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 901 days.

(21) Appl. No.: 17/493,727

(22) Filed: Oct. 4, 2021

(65) Prior Publication Data

US 2022/0023725 A1 Jan. 27, 2022

Related U.S. Application Data

(63) Continuation-in-part of application No. 17/373,603, filed on Jul. 12, 2021, now Pat. No. 11,745,062, which is a continuation of application No. 16/880,865, filed on May 21, 2020, now Pat. No. 11,058,929, which is a continuation of application No. 16/510,737, filed on Jul. 12, 2019, now Pat. No. 10,675,517.

(60) Provisional application No. 63/190,693, filed on May 19, 2021, provisional application No. 63/198,218, filed on Oct. 2, 2020, provisional application No. 62/697,304, filed on Jul. 12, 2018.

(51) Int. Cl.
*A63B 53/04* (2015.01)

(52) U.S. Cl.
CPC ..... *A63B 53/0466* (2013.01); *A63B 53/0412* (2020.08); *A63B 53/0437* (2020.08); *A63B 53/0445* (2020.08)

(58) Field of Classification Search
CPC ..... A63B 53/0445; A63B 53/0458
See application file for complete search history.

(56) References Cited

U.S. PATENT DOCUMENTS 4,630,826 A 12/1986 Nishigaki et al.
4,681,322 A 7/1987 Straza
(Continued)

FOREIGN PATENT DOCUMENTS

CN 202666332 1/2013
JP 06233837 A * 8/1994
(Continued)

OTHER PUBLICATIONS

International Search Report and Written Opinion for PCT Application No. PCT/US2012/038689, 9 pages, Nov. 23, 2012.
(Continued)

*Primary Examiner* — Alvin A Hunter

(57) ABSTRACT

Embodiments of golf club head faceplates comprising a lattice to improve the energy storage capabilities and minimize stress concentrations are described herein. The lattice can comprise a plurality of flexure shapes that facilitate in faceplate bending. The flexure shapes of the lattice can comprise a reentrant, concave, or non-convex shape. The lattice can comprise at least one repeating pattern of flexure shapes that can be interconnected or spaced apart. During golf ball impacts, the flexure shapes flex to store energy through linear and torsional bending.

20 Claims, 24 Drawing Sheets

(56) References Cited

U.S. PATENT DOCUMENTS 4,749,197 A * 6/1988 Orlowski ..... A63B 60/00 473/342
4,930,781 A * 6/1990 Allen ..... A63B 60/00 164/34
5,301,941 A * 4/1994 Allen ..... A63B 53/0466 164/34
5,377,986 A 1/1995 Viollaz et al.
5,397,126 A * 3/1995 Allen ..... A63B 60/00 473/324
5,401,021 A * 3/1995 Allen ..... A63B 53/047 473/291
5,405,137 A 4/1995 Vincent
5,425,538 A 6/1995 Vincent et al.
5,497,993 A * 3/1996 Shan ..... A63B 53/0466 473/347
5,499,814 A 3/1996 Lu
5,601,501 A * 2/1997 Kobayashi ..... A63B 53/04 473/350
5,611,742 A * 3/1997 Kobayashi ..... A63B 60/52 473/331
5,643,108 A * 7/1997 Cheng ..... A63B 53/04 473/347
5,665,013 A 9/1997 Kobayashi
5,676,605 A * 10/1997 Kobayashi ..... A63B 60/00 473/331
5,681,227 A * 10/1997 Sayrizi ..... A63B 60/00 473/350
5,711,722 A * 1/1998 Miyajima ..... A63B 53/0466 473/346
5,735,755 A * 4/1998 Kobayashi ..... A63B 53/04 473/331
5,766,094 A * 6/1998 Mahaffey ..... A63B 60/00 473/347
5,776,011 A * 7/1998 Su ..... A63B 53/0466 473/345
5,799,859 A * 9/1998 Cheng ..... A63B 60/00 228/157
5,827,131 A 10/1998 Mahaffey et al.
5,944,619 A 8/1999 Cameron
6,001,495 A 12/1999 Bristow et al.
6,074,309 A * 6/2000 Mahaffey ..... A63B 53/0466 473/345
6,114,050 A 9/2000 Westre et al.
D431,622 S * 10/2000 Sato ..... D21/748
6,179,726 B1 * 1/2001 Satoh ..... A63B 53/04 473/290
6,183,381 B1 2/2001 Grant et al.
6,240,640 B1 6/2001 Matsuoka et al.
6,299,548 B1 * 10/2001 Lin ..... A63B 53/0466 473/331
6,319,150 B1 11/2001 Werner et al.
6,322,459 B1 * 11/2001 Nishimura ..... A63B 60/00 473/331
6,334,818 B1 * 1/2002 Cameron ..... A63B 53/0487 473/332
6,379,262 B1 * 4/2002 Boone ..... A63B 53/04 473/324
6,681,612 B2 * 1/2004 Matsumoto ..... A63B 53/0466 72/352
D486,871 S 2/2004 Burrows
6,746,343 B2 * 6/2004 Yoneyama ..... A63B 53/047 473/349
6,932,716 B2 8/2005 Ehlers et al.
6,979,270 B1 * 12/2005 Allen ..... A63B 53/0466 473/290
6,986,915 B2 1/2006 Mahaffey et al.
6,997,820 B2 2/2006 Willet et al.
7,018,303 B2 * 3/2006 Yamamoto ..... A63B 60/52 473/329
7,066,833 B2 * 6/2006 Yamamoto ..... A63B 60/00 473/331
7,108,614 B2 * 9/2006 Lo ..... A63B 60/52 473/345
7,112,147 B2 9/2006 Solheim et al.
7,169,062 B2 * 1/2007 Chen ..... A63B 53/0466 473/329
7,281,990 B2 10/2007 Hagood et al.
7,367,898 B2 * 5/2008 Hawkins ..... A41D 13/015 473/332
7,367,899 B2 5/2008 Rice et al.
7,387,579 B2 * 6/2008 Lin ..... A63B 53/04 473/332
7,461,726 B2 * 12/2008 Hawkins ..... F16F 3/0876 267/116
7,500,923 B2 3/2009 Tateno
7,527,565 B1 5/2009 Ehlers et al.
7,575,524 B2 * 8/2009 Willett ..... A63B 53/047 473/345
7,614,964 B2 * 11/2009 Matsunaga ..... A63B 60/00 473/346
7,618,331 B2 * 11/2009 Hirano ..... A63B 60/00 473/346
7,708,653 B2 5/2010 Hawkins et al.
7,794,335 B2 * 9/2010 Cole ..... A63B 53/047 473/346
7,846,039 B2 12/2010 Gilbert et al.
7,874,936 B2 1/2011 Chao
7,914,394 B2 * 3/2011 Cole ..... A63B 53/047 473/332
7,946,929 B2 5/2011 Wahlin et al.
8,007,373 B2 8/2011 Soracco et al.
8,070,623 B2 * 12/2011 Stites ..... A63B 53/0466 473/346
8,221,264 B2 * 7/2012 Cole ..... A63B 53/047 473/342
8,235,842 B2 * 8/2012 Cole ..... A63B 53/047 473/332
8,323,122 B2 12/2012 Soracco et al.
8,337,324 B2 12/2012 Sander
8,439,769 B2 5/2013 Rice
8,469,834 B2 * 6/2013 Wada ..... A63B 53/0466 473/346
8,616,998 B2 * 12/2013 Cole ..... A63B 53/04 473/332
8,663,027 B2 * 3/2014 Morales ..... A63B 60/00 473/345
8,727,908 B2 * 5/2014 Goto ..... A63B 53/04 473/329
8,777,778 B2 7/2014 Solheim et al.
8,790,196 B2 7/2014 Solheim et al.
9,089,747 B2 * 7/2015 Boyd ..... A63B 60/54
9,138,619 B2 * 9/2015 Takechi ..... A63B 53/0466
9,194,452 B2 11/2015 Hawkins et al.
9,199,138 B2 12/2015 Willet
9,216,327 B2 * 12/2015 Morin ..... A63B 60/00
9,330,406 B2 5/2016 Soracco et al.
9,370,697 B2 * 6/2016 Beno ..... A63B 60/00
9,409,065 B2 * 8/2016 Morales ..... A63B 53/0466
9,669,270 B2 6/2017 Schweigert
9,724,575 B2 * 8/2017 Morin ..... A63B 60/00
9,878,217 B2 * 1/2018 Morales ..... B23K 20/233
10,195,492 B2 * 2/2019 Campbell ..... A63B 43/00
10,335,653 B1 * 7/2019 Daraskavich ..... B23K 11/115
10,343,031 B1 * 7/2019 Day ..... A63B 53/0433
10,518,144 B1 * 12/2019 Daraskavich ..... B23K 11/093
10,675,517 B2 * 6/2020 Spackman ..... A63B 53/0458
11,058,929 B2 * 7/2021 Spackman ..... A63B 60/48
11,745,062 B2 * 9/2023 Spackman ..... A63B 53/0466 473/329
2002/0019265 A1 * 2/2002 Allen ..... A63B 53/04 473/346
2002/0037776 A1 * 3/2002 Krumme ..... A63B 53/047 473/332
2004/0009829 A1 1/2004 Kapilow
2007/0225086 A1 * 9/2007 Lin ..... A63B 60/00 473/345
2007/0259736 A1 11/2007 Lo

(56) References Cited

U.S. PATENT DOCUMENTS

| | | | | |
|---|---|---|---|---|
| 2008/0045356 | A1* | 2/2008 | Lin | A63B 53/0466 473/346 |
| 2008/0139334 | A1* | 6/2008 | Willett | A63B 53/0466 473/329 |
| 2010/0267466 | A1 | 10/2010 | Stites | |
| 2012/0289360 | A1* | 11/2012 | Breier | A63B 53/047 473/335 |
| 2014/0038737 | A1* | 2/2014 | Roach | A63B 53/04 473/226 |
| 2015/0246268 | A1 | 9/2015 | Abe | |
| 2020/0070017 | A1* | 3/2020 | Aplin | B22F 1/108 |
| 2020/0346077 | A1* | 11/2020 | Aplin | B22F 1/108 |

FOREIGN PATENT DOCUMENTS

| | | | | | |
|---|---|---|---|---|---|
| JP | H06233837 | | | 8/1994 | |
| JP | 09038248 | A | * | 2/1997 | A63B 53/04 |
| JP | 09038252 | A | * | 2/1997 | A63B 53/04 |
| JP | H09038248 | | | 2/1997 | |
| JP | H09038252 | | | 2/1997 | |
| JP | 09187535 | A | * | 7/1997 | A63B 53/04 |
| JP | H09187535 | | | 7/1997 | |
| JP | 09276456 | A | * | 10/1997 | A63B 53/04 |
| JP | H09276456 | | | 10/1997 | |
| JP | 09299521 | A | * | 11/1997 | |
| JP | H09299521 | | | 11/1997 | |
| JP | 2002165905 | | | 6/2002 | |
| JP | H3333386 | | | 10/2002 | |
| JP | 2004089567 | | | 3/2004 | |
| JP | 2004089567 | A | * | 3/2004 | |
| JP | 2017086766 | A | | 5/2017 | |
| JP | 2023545405 | A | * | 10/2023 | |
| JP | 7516665 | B2 | * | 7/2024 | A63B 53/04 |
| JP | 2024138341 | A | * | 10/2024 | A63B 53/04 |
| KR | 20230070514 | A | * | 5/2023 | |
| WO | WO-2020014678 | A1 | * | 1/2020 | A63B 53/0408 |
| WO | WO-2022072939 | A1 | * | 4/2022 | A63B 53/04 |

OTHER PUBLICATIONS

International Search Report and Written Opinion for PCT Application No. PCT/US2016/033822, 8 pages, Aug. 19, 2016.

Saxema et al., Three Decades of Auxetics Research—Materials with Negative Poisson's Ratio: A Review, 18, Advanced Engineering Materials, 1847-1870 (2016).

* cited by examiner

GOLF CLUB HEAD FACEPLATES WITH LATTICES

CROSS REFERENCE TO RELATED APPLICATIONS

This claims the benefit of U.S. Provisional No. 63/190,693, filed May 19, 2021, U.S. Provisional No. 63/198,218, filed Oct. 2, 2020, and is a continuation-in-part of U.S. patent application Ser. No. 17/373,603, filed on Jul. 12, 2021, which is a continuation of U.S. patent application Ser. No. 16/880,865, filed on May 21, 2020, and is issued as U.S. Pat. No. 11,058,929 on Jul. 13, 2021, which is a continuation of U.S. patent Ser. No. 16/510,737, filed on Jul. 12, 2019, and is issued as U.S. Pat. No. 10,675,517 on Jun. 9, 2020, which claims the benefit of U.S. Provisional No. 62/697,304, filed Jul. 12, 2018. The contents of all the above-described disclosures are incorporated fully herein by reference in their entirely.

FIELD OF THE INVENTION

This invention generally relates to golf club head faceplates with lattices.

BACKGROUND

Golf club design takes into account several performance characteristics, such as ball speed. Typically, golf club designs aim to increase ball speed by increasing the deflection or flexibility capabilities of the faceplate. However, current designs are limited due to manufacturing or structural considerations. Therefore, there is a need in the art for a club head with a faceplate that further increases ball speed while minimizing stress concentrations.

Figure 1:
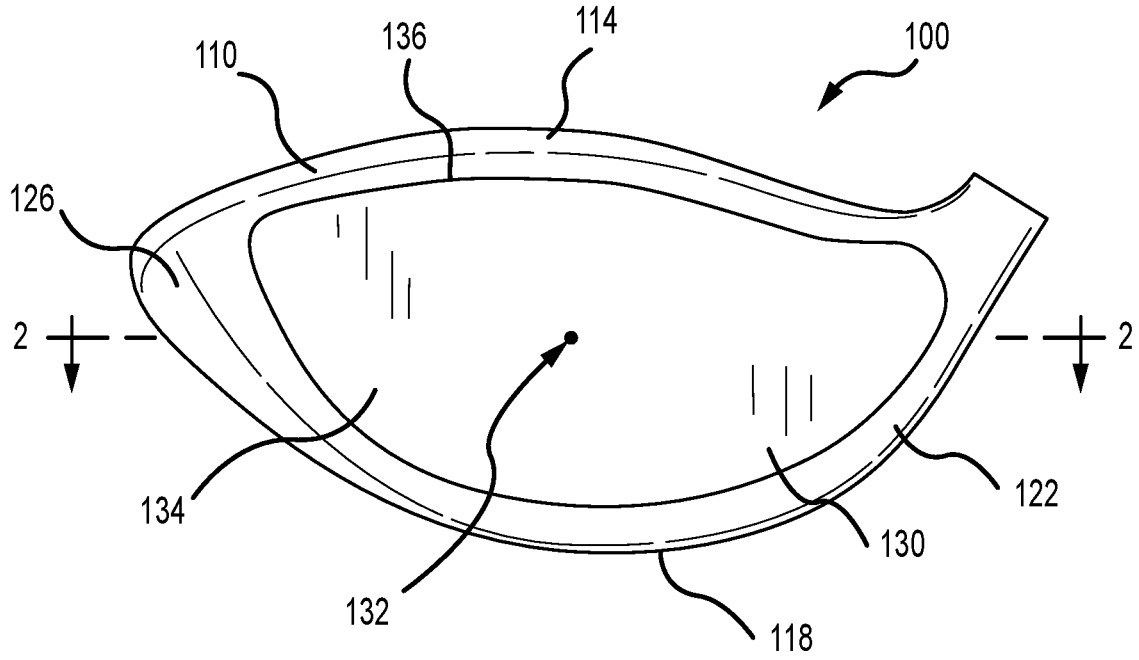
FIG. 1 illustrates a front view of a golf club head faceplate according to an embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf club heads with lattices. The same reference numerals in different figures denote the same elements.

DETAILED DESCRIPTION

The present embodiments discussed below are directed to golf club head faceplates comprising a lattice. The lattice comprises a plurality of flexure shapes that facilitate faceplate bending. The flexure shapes of the lattice comprise a reentrant shape (i.e. shape that points inward), a concave shape, or a non-convex shape. The lattice comprises a repeating pattern of flexure shapes that can be interconnected or spaced apart from one another. The dimensions, the shape, and the pattern of the lattice affects the bending of the faceplate during golf ball impacts. During golf ball impacts, the flexure shapes of the lattice act as tiny springs that store energy through linear and torsional bending. Storing energy through two modes of bending provides greater energy storage in the faceplate, which allows for greater ball speeds during golf ball impacts. Further, the flexure shapes of the lattice reduce the largest stresses concentrated in a small volume of the faceplate material (i.e. impact area of the faceplate) by displacing the reduced stress over a greater volume of the faceplate material. This allows the largest stresses to be moved away from an impact area of the faceplate thereby increasing the faceplate durability. The combination of spreading the stress over a larger volume of faceplate material and the two modes of bending leads to a 1 to 3 mph increase in ball speed.

Further, the lattice comprising the plurality of flexure shapes can adjust the characteristic time (CT) of the faceplate. The lattices described in this disclosure controls CT or reduces CT variability within the United States Golf Association (USGA) regulations. In one example, controlling CT can be accomplished by designing the faceplate lattice with flexure shapes oriented in a low-heel to high-toe direction, or in a low-toe to high-heel direction. The faceplate comprising the lattice with flexure shapes reduces characteristic time while maintaining similar ball speed performance when compared to a similar faceplate devoid of the lattice with flexure shapes. In some examples, the faceplate comprising the lattice with the flexure shapes decreases the center CT by about 1 to 10 μs, or 1 to 5 μs when compared to a similar faceplate devoid of the lattice with flexure shapes. The faceplate comprising the lattice with flexure shapes maintains similar ball speed performance compared to the similar faceplate devoid of the lattice with flexure shapes. The faceplates comprising the lattice with flexure shapes provides desirable, lower characteristic time values while not sacrificing high ball speed performance.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The term characteristic time "CT" is used herein to mean a measurement used to determine the amount of time, measured in microseconds (μs), that a golf ball contacts the club face at the moment of impact. The characteristic time is measured by impacting a specific spot on the striking surface several times using a small steel pendulum. The characteristic time measurement is for wood-type club heads such as drivers, fairway woods, or hybrids. A computer program measures the amount of time the steel pendulum contacts the club face at the moment of impact. CT values were based on the method outlined in the USGA's Procedure for Measuring the Flexibility of a Golf Clubhead. For example, Section 2 of the USGA's Procedure for Measuring the Flexibility of a Golf Clubhead (USGA-TPX3004, Rev. 2.0, Apr. 9, 2019) (the "Protocol For Measuring The Flexibility of A Golf Club Head").

The terms "loft" or "loft angle" of a golf club, as described herein, refers to the angle formed between the club face and the shaft, as measured by any suitable loft and lie machine.

"Driver golf club heads" as used herein comprise a loft angle less than approximately 16 degrees, less than approximately 15 degrees, less than approximately 14 degrees, less than approximately 13 degrees, less than approximately 12 degrees, less than approximately 11 degrees, or less than approximately 10 degrees. "Driver golf club heads" as used herein comprise a volume greater than approximately 400 cc, greater than approximately 425 cc, greater than approximately 445 cc, greater than approximately 450 cc, greater than approximately 455 cc, greater than approximately 460 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In other embodiments, the volume of drivers can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

"Fairway wood golf club heads" as used herein comprise a loft angle of less than approximately 35 degrees, less than approximately 34 degrees, less than approximately 33 degrees, less than approximately 32 degrees, less than approximately 31 degrees, or less than approximately 30 degrees. Further, in other embodiments, the loft angle of fairway woods can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. In other embodiments still, the loft angle of fairway woods can be between 12 degrees and 35 degrees, between 15 degrees and 35 degrees, between 20 degrees and 35 degrees, or between 12 degrees and 30 degrees.

Further, "fairway wood golf club heads" as used herein comprise a volume less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In other embodiments, the volume of the fairway woods can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

"Hybrid golf club heads" as used herein comprise a loft angle less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in other embodiments, the loft angle of hybrids can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

Further, "hybrid golf club heads" as used herein comprise a volume less than approximately 200 cc, less than approximately 175 cc, less than approximately 150 cc, less than approximately 125 cc, less than approximately 100 cc, or less than approximately 75 cc. In some embodiments, the volume of the hybrid-type club head can be approximately 100 cc-150 cc, approximately 75 cc-150 cc, approximately 100 cc-125 cc, or approximately 75 cc-125 cc.

"Iron golf club heads" as used herein comprise a loft angle greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, greater than approximately 25 degrees, greater than approximately 26 degrees, greater than approximately 27 degrees, greater than approximately 28 degrees, greater than approximately 29 degrees, greater than approximately 30 degrees, greater than approximately 31 degrees, greater than approximately 32 degrees, greater than approximately 33 degrees, greater than approximately 34 degrees, greater than approximately 35 degrees, greater than approximately 36 degrees, greater than approximately 37 degrees, greater than approximately 38 degrees, greater than approximately 39 degrees, greater than approximately 40 degrees, greater than approximately 41 degrees, greater than approximately 42 degrees, greater than approximately 43 degrees, greater than approximately 44 degrees, greater than approximately 45 degrees, greater than approximately 46 degrees, greater than approximately 47 degrees, greater than approximately 48 degrees, greater than approximately 49 degrees, greater than approximately 50 degrees, greater than approximately 51 degrees, greater than approximately 52 degrees, greater than approximately 53 degrees, greater than approximately 54 degrees, greater than approximately 55 degrees, greater than approximately 56 degrees, greater than approximately 57 degrees, greater than approximately 58 degrees, greater than approximately 59 degrees, or greater than approximately 60 degrees.

In other embodiments, the loft angle of irons can range from 17 degrees to 60 degrees. In other embodiments still, the loft angle of the irons can range from 17 degrees to 50 degrees, or 17 degrees to 40 degrees. For example, the loft angle of irons can be 60 degrees, 59 degrees, 58 degrees, 57 degrees, 56 degrees, 55 degrees, 54 degrees, 53 degrees, 52 degrees, 51 degrees, 50 degrees, 49 degrees, 48 degrees, 47 degrees, 46 degrees, 45 degrees, 46 degrees, 45 degrees, 44 degrees, 43 degrees, 42 degrees, 41 degrees, 40 degrees, 39 degrees, 38 degrees, 37 degrees, 36 degrees, 35 degrees, 34 degrees, 33 degrees, 32 degrees, 31 degrees, 30 degrees, 29 degrees, 28 degrees, 27 degrees, 26 degrees, 25 degrees, 24 degrees, 23 degrees, 22 degrees, 21 degrees, 20 degrees, 19 degrees, 18 degrees, or 17 degrees.

For ease of discussion and understanding, and for purposes of description only, the following detailed description illustrates a golf club head as a driver. It should be appreciated that the driver is provided for purposes of illustration of the faceplate lattices with the purpose of increasing ball speed. As described above, the disclosed faceplate with lattices can be used in association with any desired driver, fairway wood, hybrid, iron, wood generally, or iron generally.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Golf Club Head Faceplates with Lattice

Described herein is a golf club head faceplate comprising a lattice. The lattice comprises a plurality of flexure shapes that facilitate in faceplate bending. During golf ball impacts, the flexure shapes of the faceplate lattice act as tiny springs that store energy through linear and torsional bending. Storing energy through two modes of bending allows for greater faceplate energy storage, which results in greater ball speeds during golf ball impacts. Further, the flexure shapes of the lattice reduce the largest stresses that occur over a small volume of the faceplate material and displaces the reduced stress over a greater volume of the faceplate material.

Referring to the drawings, wherein like reference numerals are used to identify like or identical components in various views, FIG. 1 schematically illustrates a front view of a golf club head 100. The golf club head 100 includes a faceplate 130 and a body 110 that are secured together to define a substantially closed/hollow interior volume. The club head 100 includes a crown 114, a sole 118 opposite the crown 114, a heel 122, and a toe 126 opposite the heel 122.

Figure 2:
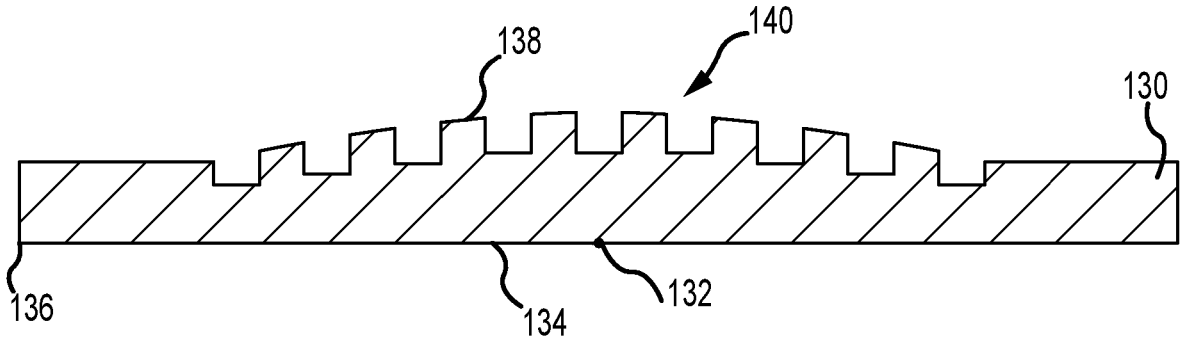
FIG. 2 illustrates a cross sectional view of the golf club head of FIG. 1.

As illustrated in FIGS. 1 and 2, the faceplate 100 includes a strike face 134 intended to impact a golf ball, and a back face 138 opposite the strike face 134. The faceplate 130 further comprises a center 132 located at a geometric center of the faceplate 130, and a perimeter 136 that extends entirely around the faceplate 130 near the crown 114, toe 126, sole 118, and heel 122 of the club head 100.

To withstand the impact stresses that occur when club head 100 strikes a golf ball, the faceplate 130 is formed from a metal, or metal alloy, and preferably a light-weight metal alloy, such as, for example, a stainless steel or steel alloy, for example, but not limited to, C300, C350, Ni (Nickel)-Co (Cobalt)-Cr(Chromium)-Steel Alloy, 565 Steel, AISI type 304 or AISI type 630 stainless steel, a titanium alloy, for example, but not limited to Ti-6-4, Ti-3-8-6-4-4, Ti-10-2-3, Ti 15-3-3-3, Ti 15-5-3, Ti185, Ti 6-6-2, Ti-7s, Ti-9s, Ti-92, or Ti-8-1-1 Titanium alloy, an amorphous metal alloy, or other similar metals.

The faceplate of the club head 100 further includes a lattice 140 having a plurality of flexure shapes recessed into the faceplate 130. The lattice 140 can be recessed into the back face 138 of the faceplate 130. The lattice 140 can be located within the closed/hollow interior volume of the club head 100, where the lattice 140 is not exposed or visible to an exterior surface of the club head 100.

Figure 3:
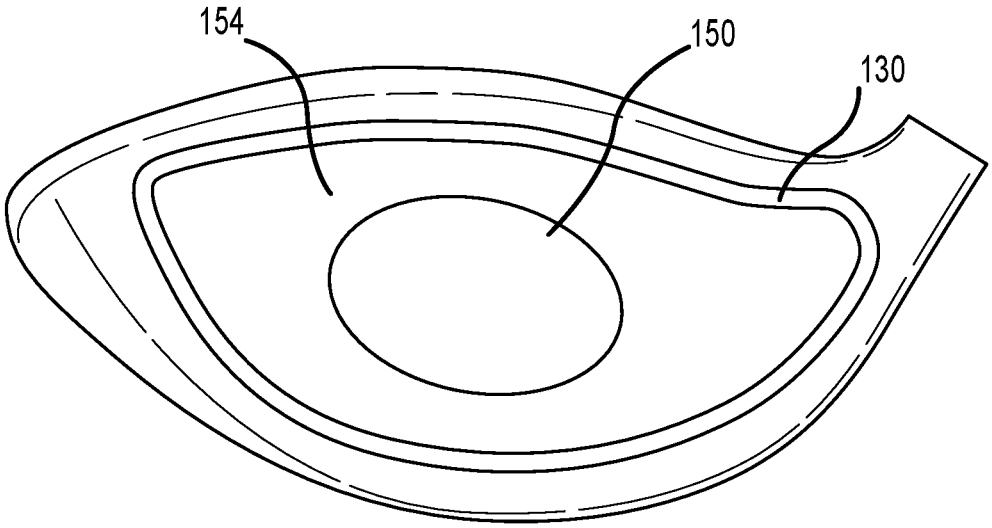
FIG. 3 illustrates a front view of a golf club head faceplate subdivided into different faceplate regions.
Figure 4:
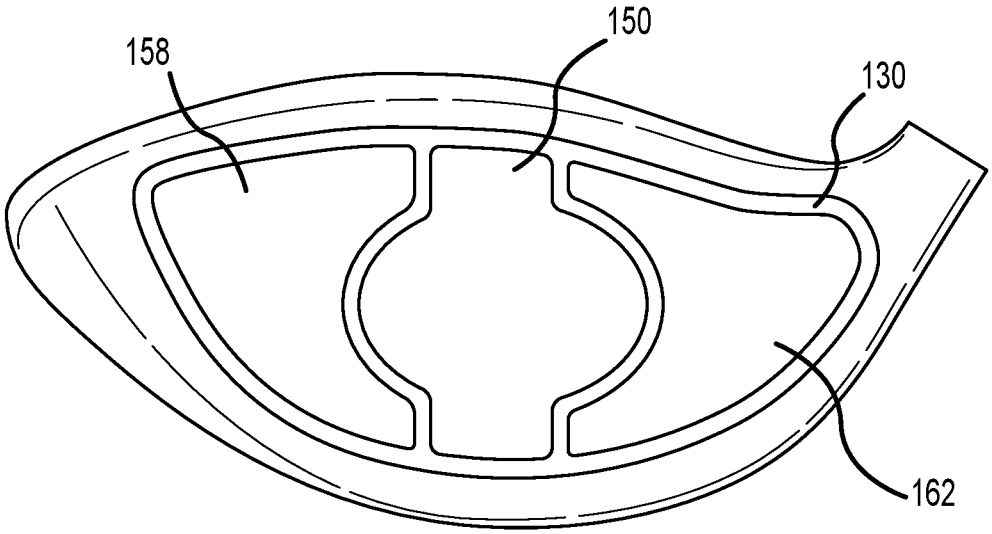
FIG. 4 illustrates a front view of a golf club head faceplate subdivided into different faceplate regions.
Figure 5:
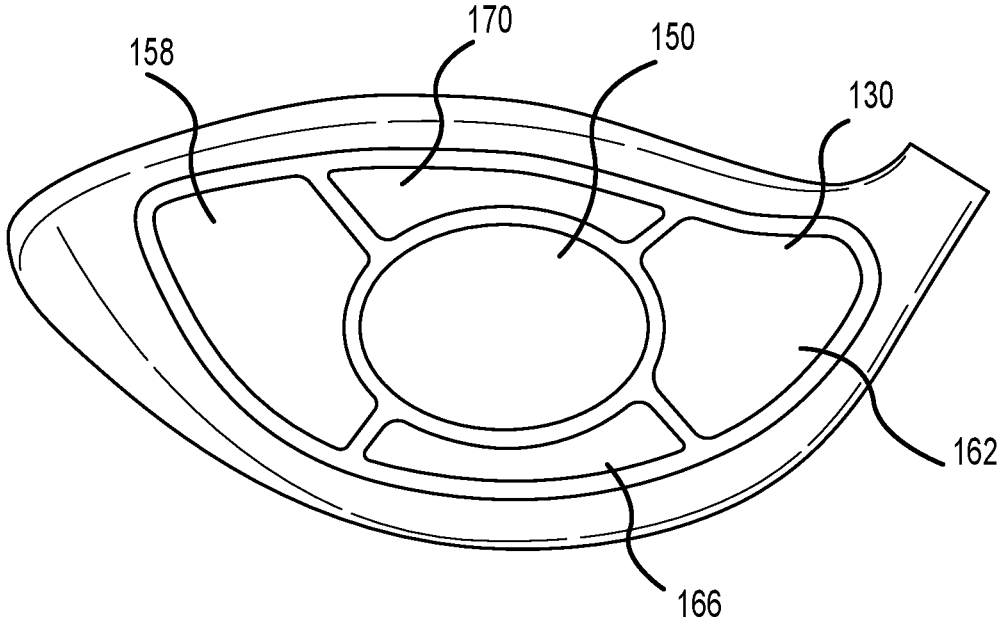
FIG. 5 illustrates a front view of a golf club head faceplate subdivided into different faceplate regions.

As illustrated in FIGS. 3-5, the lattice 140 can be positioned in a region of the faceplate 130. The faceplate 130 can comprise a center region 150 located near the faceplate center 132 of the faceplate 130, a toe region 158 located near the toe 126 of the club head 100, a heel region 162 located near the heel 162 of the club head 100, a bottom region 166 located near the sole 118 of the club head 100, and a top region 170 located near the crown 114 of the club head 100. The lattice 140 can be positioned on the center region 150, the toe region 158, the heel region 162, the bottom region 166, the top region 170, or any combination thereof.

Figure 6:
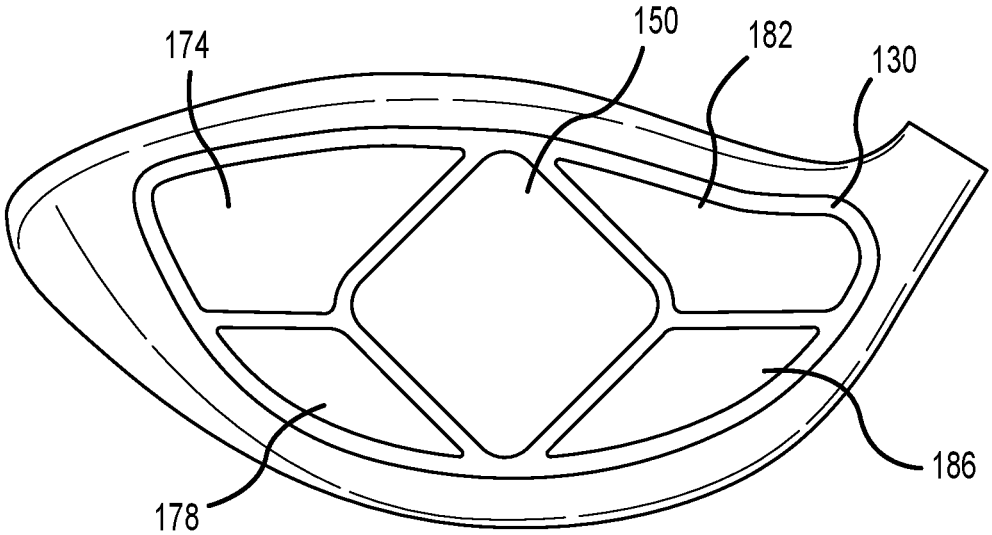
FIG. 6 illustrates a front view of a golf club head faceplate subdivided into different faceplate regions.
Figure 18:
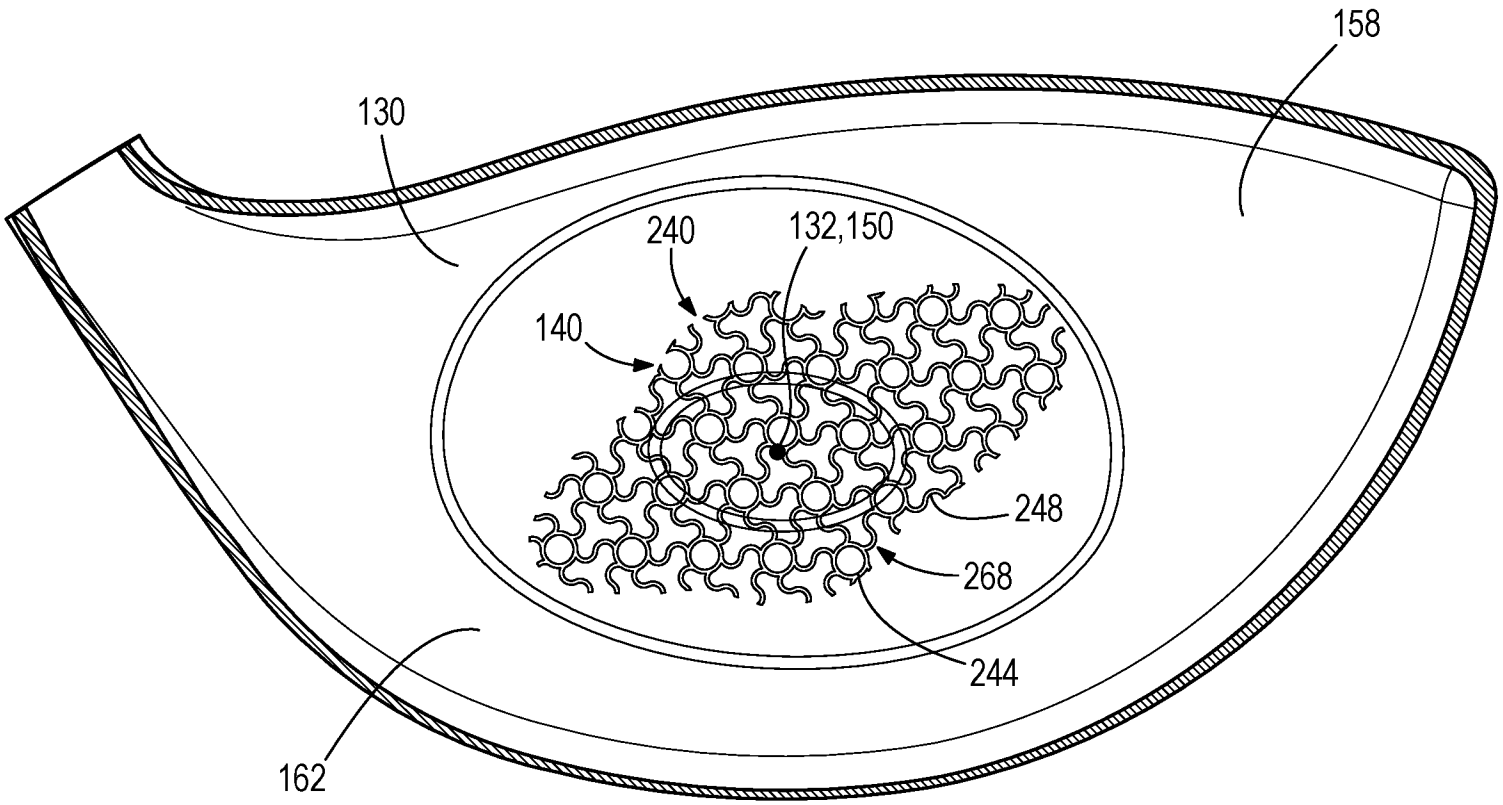
FIG. 18 illustrates a rear surface of a golf club head faceplate comprising a sunburst groove faceplate lattice according to an embodiment.
Figure 21:
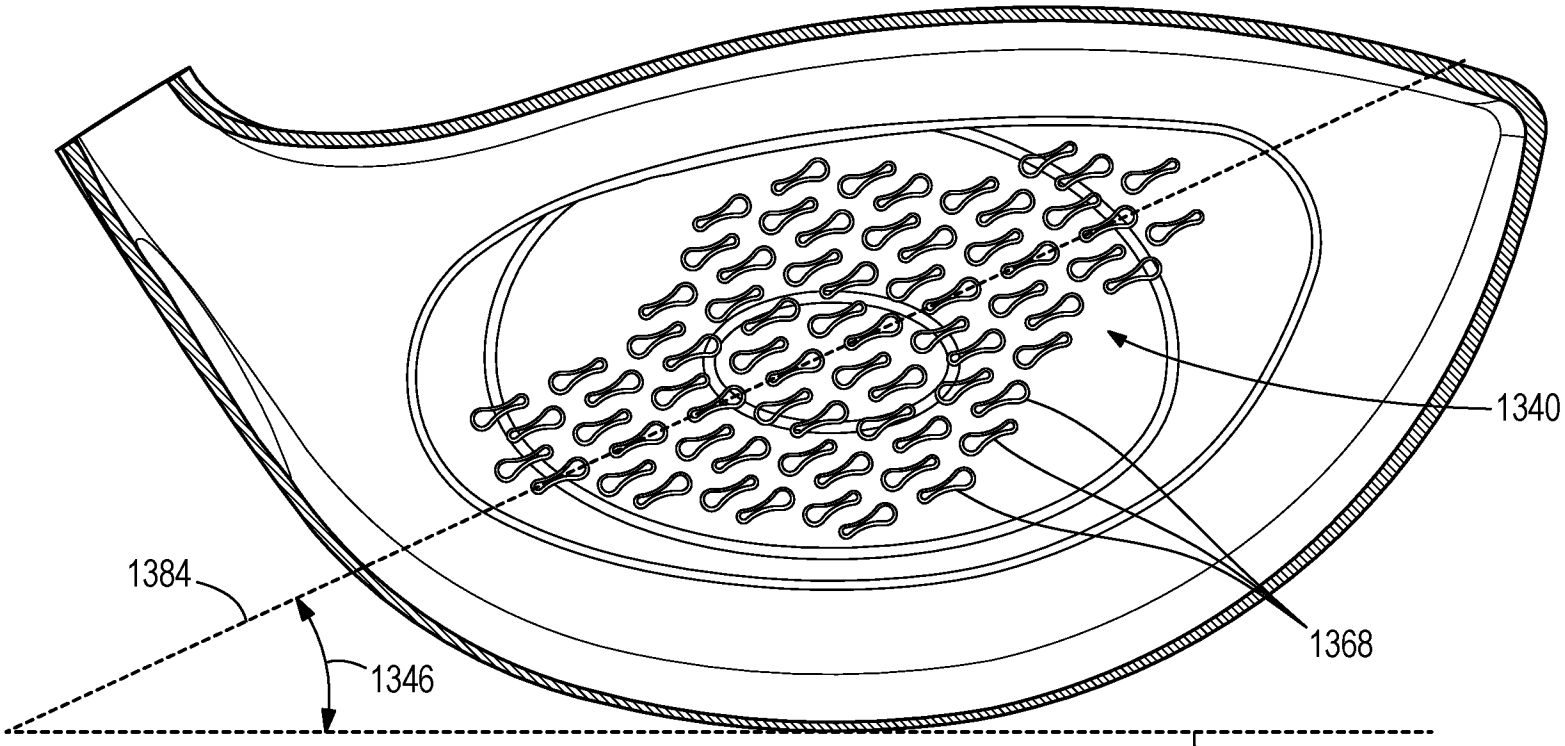
FIG. 21 illustrates a rear surface of a golf club faceplate comprising a bone flexure shape recess faceplate lattice according to an embodiment.

In other embodiments, as illustrated in FIG. 6, the faceplate 130 can further comprise a high-toe region 174, a low-toe region 178, a high-heel region 182, a low-heel region 186. The lattice 140 can be positioned on the high-toe region 174, the low-toe region 178, the high-heel region 182, the low-heel region 178, or any combination thereof. In some embodiments, the lattice 140 can cover a circular region, an elliptical region, or a combination thereof, centered around the geometric center of the faceplate. In some examples, the elliptical region is aligned from the low heel towards the high toe. For example, moving ahead, FIGS. 18 and 21 illustrate lattice patterns aligned approximately from the low heel towards the high toe. The lattice illustrated in FIGS. 18 and 21 covers both a circular region and an elliptical region. The location of the lattice 140 on the faceplate 130 can affect how the faceplate 130 bends during golf ball impacts.

In some embodiments, the lattice 140 can provide a faceplate 130 that has asymmetric bending to achieve different golf ball shot shapes such as draw, fade, or straight. In one example, the lattice 140 can be positioned in the high-toe region 174 and the low-heel region 186 to provide a draw bias shot shape (i.e. right-to-left ball flight). In another example, the lattice 140 can be positioned in the high-heel region 182 and low-toe region 178 to provide a fade bias shot shape (i.e. left-to-right ball flight).

In other embodiments, the lattice 140 can be positioned on an exterior surface of the club head 100 or an interior surface of the club head 100 located adjacent the closed/interior volume. More specifically, the lattice 140 can be positioned on the crown 114, the sole 118, the toe 126, the heel 122, or any combination thereof. In other embodiments still, the lattice 140 can be positioned in the faceplate 130 and at least one of the crown 114, the sole 118, the toe 126, or the heel 122. In other embodiments, a portion of the crown 114 or sole 118 can be formed as an insert that can be attached to the club head 100, where the lattice 140 is formed on the insert. In other embodiments still, the club head 100 can be integrally formed as one component or piece, where the lattice 140 can be integrally formed along with the club head 100 on at least one of the crown 114, the sole 118, the toe 126, or the heel 122. The lattice 140 positioned in at least one of the crown 114 or the sole 118 can minimize the stress concentrations and move the largest stress concentrations away from the thinnest portions of the crown 114 or sole 118.

The lattice 140 can comprise a percentage of a surface area of the back face. In some embodiments, the lattice 140 can comprise greater than 40%, greater than 45%, greater than 50%, greater than 55%, greater than 60%, greater than 65%, greater than 70%, or greater than 75% of the back face surface area. In other embodiments, the lattice 140 can comprise 10% to 100% of the back face surface area. In some embodiments, the lattice 140 can comprise 10% to 95%, 10% to 90%, 10% to 85%, 10% to 80%, 10% to 75%, 10% to 70%, 10% to 65%, 10% to 60%, 10% to 55%, or 10% to 50% of the back face surface area. In some embodiments, the lattice 140 can comprise 10% to 25%, 25% to 40%, 40% to 55%, 55% to 70%, 70% to 85%, or 85% to 100% of the back face surface area. For example, the lattice 140 can comprise 10%, 20%, 30%, 40%, 50%, 55%, 60%, 65%, 70%, 75%, 80%, 85%, 90%, 95%, or 100% of the back face surface area.

The lattice 140 can comprise at least one repeating pattern. In some embodiments, the lattice 140 can comprise a plurality of repeating patterns. For example, the lattice 140 can comprise one, two, three, four, or five repeating patterns. In other embodiments, the at least one repeating pattern can be a radial pattern, where the pattern repeats in a direction of a radius (i.e. from the faceplate center to the faceplate perimeter).

In some embodiments, the lattice 140 can comprise a plurality of rows. Adjacent rows can be staggered or offset from each other. The plurality of rows can be aligned linearly, radially, curvilinear, or arcuately. The plurality of rows can be angled in a low-heel to high-toe direction, a low-toe to high-heel direction, a horizontal direction, a vertical direction, or any combination thereof.

The number of flexure shapes of the lattice 140 can influence how the lattice 140 stores energy in the faceplate. In some embodiments, the number of flexure shapes can increase, decrease, or remain constant towards the center region 150, the toe region 158, the heel region 162, the bottom region 166, the top region 170, the high-toe region 174, the low-toe region 178, the high-heel region 182, or the low-heel region 178. For example, the number of flexure shapes can decrease towards the toe region 158 of the faceplate 130. In another example, the number of flexure shapes can decrease towards the bottom region 166 of the faceplate 130. In other example, the number of flexure shapes can decrease towards the heel region 162 of the faceplate 130. In another example, the number of flexure shapes can decrease towards the top region 170 of the faceplate 130.

The size (i.e. volume) of the flexure shapes of the lattice 140 can influence how the lattice 140 stores energy in the faceplate. In some embodiments, the size of the flexure shapes can increase, decrease, or remain constant towards the center region 150, the toe region 158, the heel region 162, the bottom region 166, the top region 170, the high-toe region 174, the low-toe region 178, the high-heel region 182, or the low-heel region 178. For example, the size of the flexure shapes can be greater at the toe region 158 than the heel region 162 to facilitate in toe bending of the faceplate 130. In another example, the size of the flexure shapes can be greater at the bottom region 166 than the top region 170 to facilitate in sole bending of the faceplate 130. In another example, the size of the flexure shapes can be greater at heel region 162 than the toe region 158 to facilitate in heel bending of the faceplate 130. In another example, the size of the flexure shapes can be greater at the top region 170 than the bottom region 166 to facilitate in crown bending of the faceplate 130.

The number of flexure shapes can correspond with the size of the flexure shapes. The number of flexure shapes can have an inverse relationship with the size of the flexure shapes. As the size of the flexure shapes increases, the number of flexure shapes decreases. Stated another way, as the size of the flexure shapes decreases, the number of flexure shapes increases. The size and the number of flexure shapes along with the positioned of the flexure shapes on the faceplate 130 can further enhance a desirable golf ball shot shape such as draw, fade, or straight.

Figure 7:
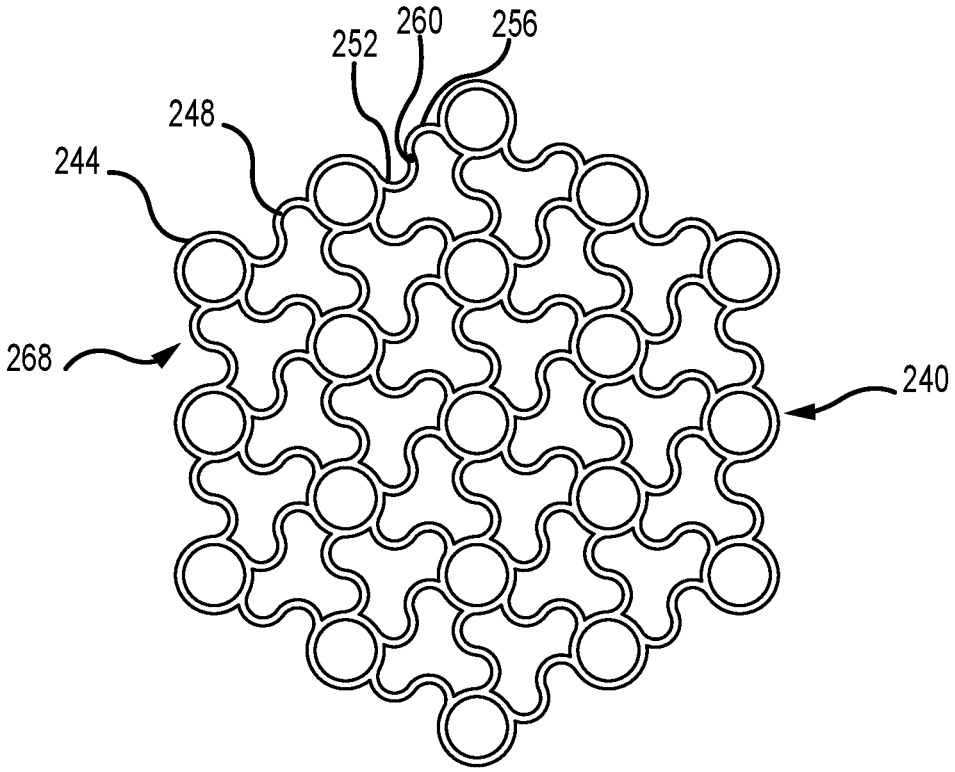
FIG. 7 illustrates a portion of a sunburst groove faceplate lattice.
Figure 8:
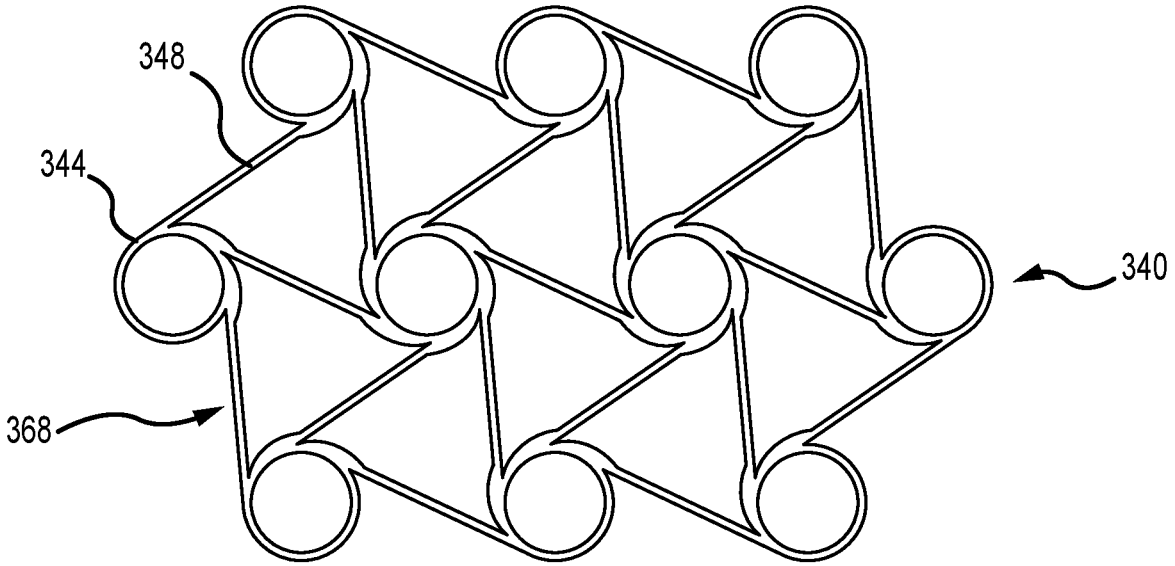
FIG. 8 illustrates a portion of a chiral groove faceplate lattice.
Figure 9:
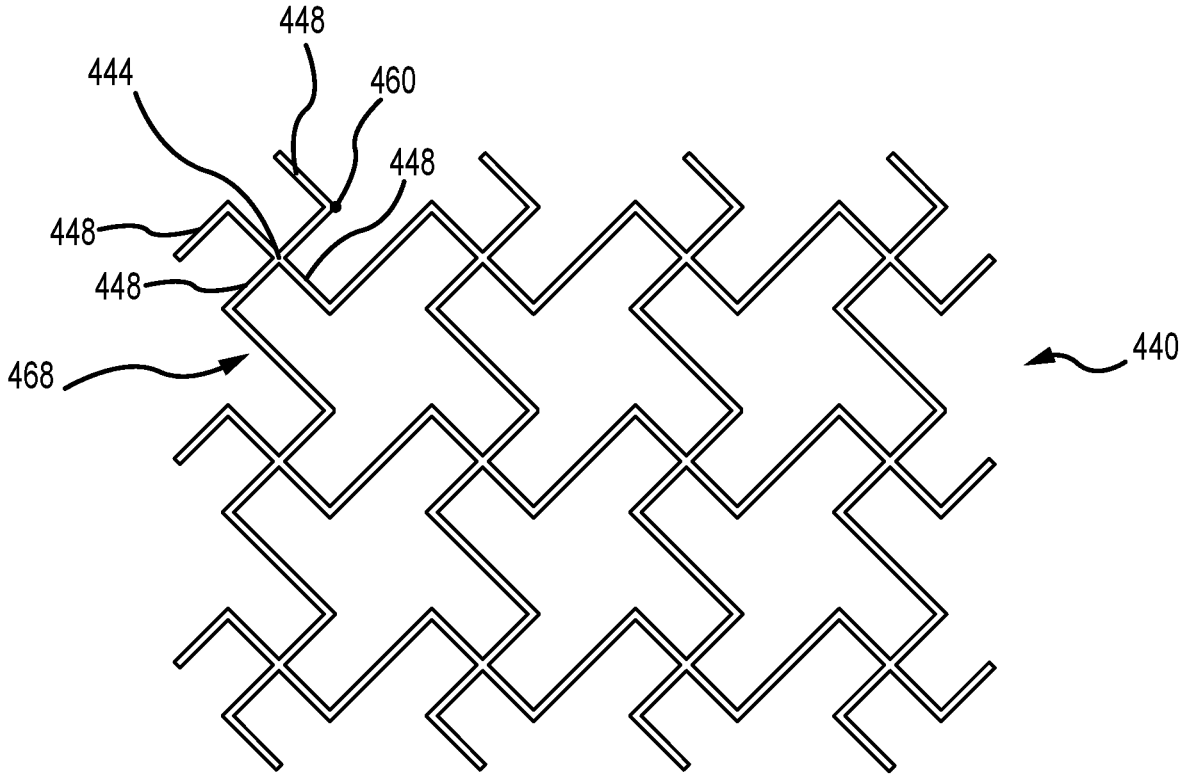
FIG. 9 illustrates a portion of a windmill groove faceplate lattice.

The plurality of flexure lattice 140 shapes facilitate faceplate bending. The flexure shapes of the lattice 140 can comprise a reentrant (i.e. shape pointing inward), concave, or non-convex shape. As illustrated in FIGS. 7-9, the flexure shapes of the lattice 140 can comprise a series of interconnected grooves. The series of interconnected grooves can comprise a base groove, and a plurality of ligament grooves connected to the base groove. The series of interconnected grooves can comprise a repeating pattern of base grooves, and a repeating pattern of ligament grooves, where the repeating pattern of base grooves and ligament grooves are interconnected to from the flexure shapes. The flexure shapes can be formed from a portion of the base groove and the ligament grooves, where portions of the flexure shape are either concave or convex relative to a center of the flexure shape. As described in more detail below, the series of interconnected grooves can be arranged in a sunburst pattern, a chiral pattern, or a windmill pattern.

In some embodiments, as illustrated in FIGS. 10-14, the flexure shapes of the lattice 140 can be formed from a plurality of land portions, where the plurality of land portions form a plurality of flexure shape recesses. The flexure shape recess can comprise at least two vertices that define acute interior angles and at least one vertex defining a reflex angle on a perimeter of the flexure shape recess. The at least one reflex angle vertex is positioned between the at least two acute interior angle vertices. The at least one reflex angle vertex does not define an acute interior angle. The acute interior angle can define an angle less than 90 degrees, and the reflex angle can define an angle greater than 180 degrees and less than 360 degrees. The at least one reflex angle vertex of the flexure shape recess can define the reentrant, concave, or non-convex shape of the flexure shape recess. As described in more detail below, the flexure shape recesses formed from the land portions can comprise a plurality of Evan, arrowhead, four-pointed star, six-pointed star, three-pointed star, or bone flexure shape recesses.

Figure 15:
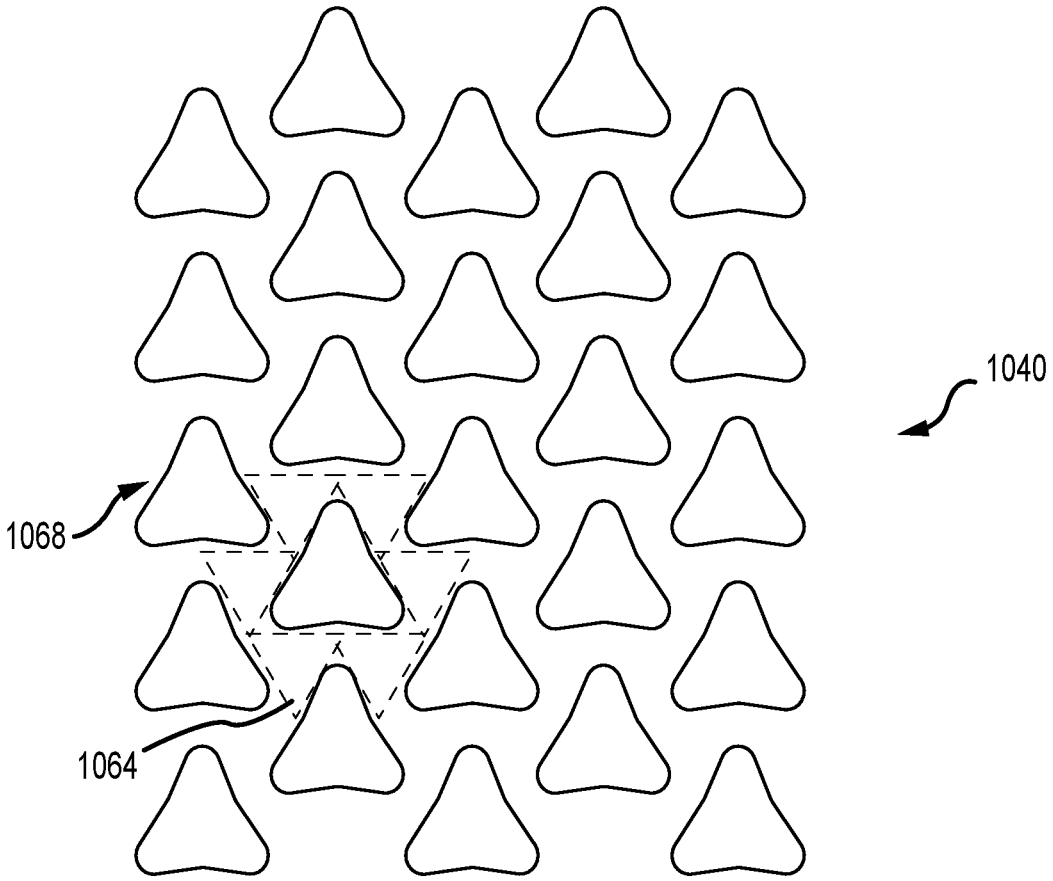
FIG. 15 illustrates a portion of a faceplate lattice comprising land portions forming triangule shapes.
Figure 16:
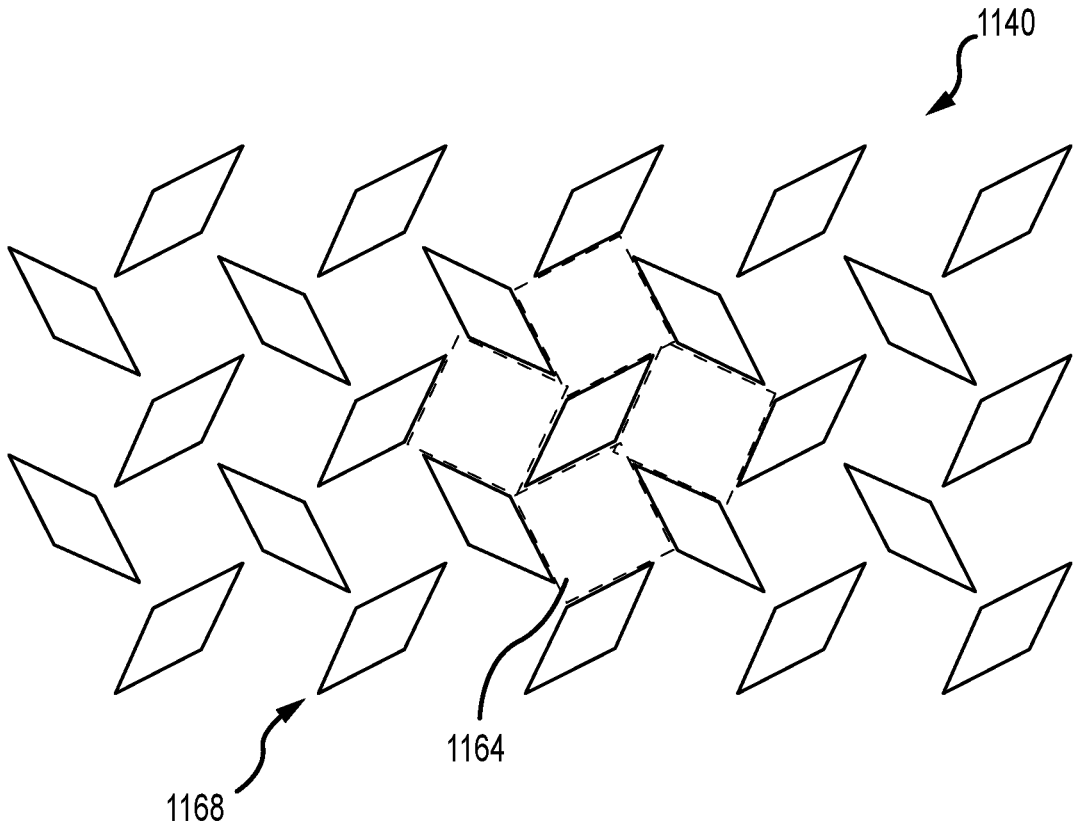
FIG. 16 illustrates a portion of a faceplate lattice comprising land portions forming quadrilateral shapes.
Figure 17:
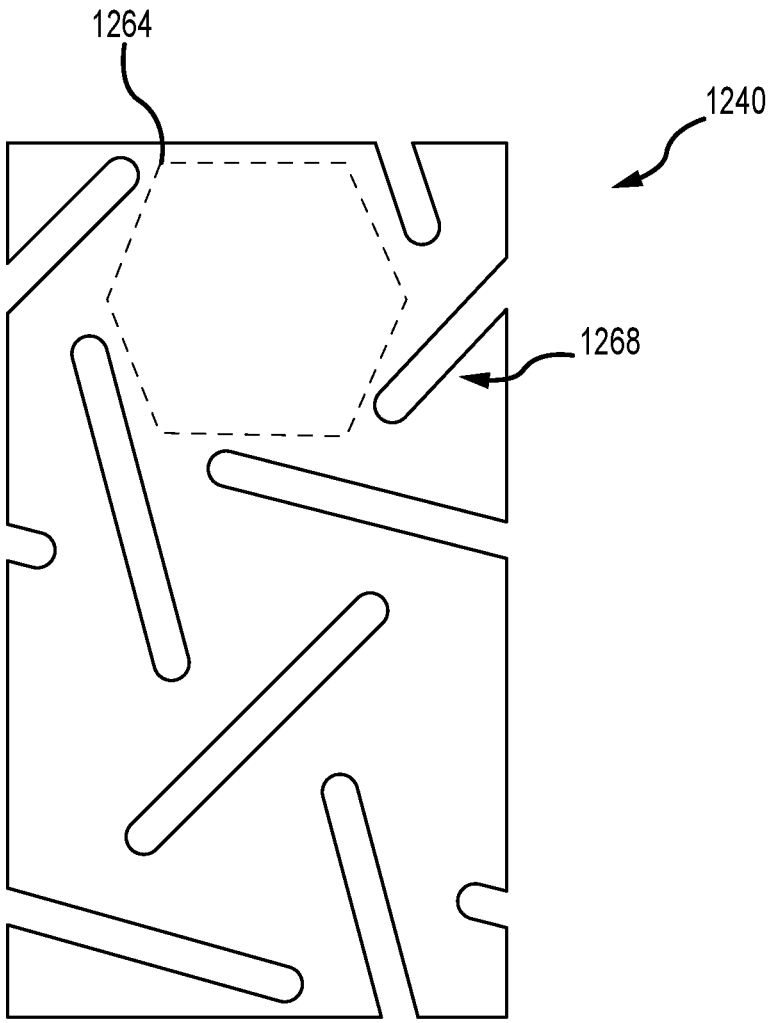
FIG. 17 illustrates a portion of a faceplate lattice comprising land portions forming hexagonal shapes.

In other embodiments, as illustrated in FIGS. 15-17, the flexure shapes can be formed from a plurality of land portions, where the plurality of land portions form a plurality of flexure shape recesses. In these embodiments, the land portions can comprise a geometric shape between adjacent flexure shape recesses. The geometric shape of the land portions can comprise a triangle, a square, a rectangle, a rhombus, a parallelogram, or a hexagon. The plurality of land portions can comprise a plurality of interconnected shapes, where each land portion geometric shape can define a portion of one or more flexure shape recesses. As described in more detailed below, the flexure shapes recesses formed from the land portions with geometric shapes can comprise a plurality of triad, diamond, or slot flexure shape recesses.

Further, in some embodiments, the faceplate lattice 140 can exhibit auxetic behavior. Auxetic behavior can be define as structures that have a near zero or negative Poisson's ratio. In other words, as the auxetic structure is stretched or a tension force is applied, the structure tends to become thicker (as opposed to thinner) or expand in a direction perpendicular to the applied force. In contrast, materials with a positive Poisson's ratio that are not near zero, contract in a direction perpendicular to the applied force. Auxetic structures are advantageous for club head faceplates because the expansive property of auxetic structures when stretched in tension increases the flexibility of the faceplate and the faceplate energy storage. Increasing the faceplate energy storage results in increases in ball speed during golf ball impacts.

Based on finite element simulations measuring the internal energy of the faceplate 130 during golf ball impacts, the faceplate 130 comprising a lattice 140 increases the internal energy storage by 10% to 20% compared to a faceplate devoid of the lattice 140. In some embodiments, the internal energy storage can increase by 10% to 15%, or 15% to 20%. This increase in internal energy storage equates to approximately a 1.0 to 3.0 mph increase in ball speed compared to a faceplate devoid of the lattice 140. In some embodiments, the ball speed increases by 1.0 to 2.0 mph, or 2.0 to 3.0 mph. In some embodiments, the ball speed increases by 1.0 to 1.5 mph, 1.5 to 2.0 mph, 2.0 to 2.5 mph, or 2.5 to 3.0 mph. This increase in ball speed equates to approximately a 5 to 15 yard increase in ball distance compared to a faceplate devoid of the lattice 140. In some embodiments, the ball distance increases by 5 to 10 yards, or 10 to 15 yards. In some embodiments, the ball distance increases by 5 to 7 yards, 7 to 9 yards, 9 to 11 yards, 11 to 13 yards, or 13 to 15 yards. The advantages of the faceplate 130 comprising the lattice 140 are described in more detail below.

Based on coefficient of restitution (COR) faceplate tests measuring the faceplate 130 during golf ball impacts, the faceplate 130 comprising the lattice 140 increases the COR by 2% to 10% compared to a faceplate devoid of the lattice 140. In some embodiments, the COR can increase by 2% to 5%, or 5% to 10% compared to a faceplate devoid of the lattice 140. For example, the COR of the faceplate 130 having the lattice 140 can increase by 2%, 3%, 4%, 5%, 6%, 7%, 8%, 9%, or 10% compared to a faceplate devoid of the lattice 140.

The dimensions of the lattice 140 can influence how the lattice stores energy in the faceplate. For example, the lattice 140 can comprise a depth measured as a distance from the back face 138 to a bottom surface of the lattice 140 in a direction perpendicular to the back face 138. The lattice 140 depth can range from 0.025 inch to 0.075 inch. The lattice 140 depth can range from 0.025 inch to 0.05 inch, or 0.05 inch to 0.075 inch. For example, the lattice 140 depth can be 0.025, 0.03, 0.035, 0.04, 0.045, 0.05, 0.055, 0.06, 0.065, 0.07, or 0.075 inch. In one example, the lattice 140 depth can be 0.05 inch.

In other embodiments, the lattice 140 depth can range from 0.005 inch to 0.025 inch. In other embodiments, the lattice 140 depth can range from 0.005 inch to 0.015 inch, or 0.015 to 0.025 inch. In other embodiments, the lattice 140 depth can range from 0.005 inch to 0.01 inch, 0.01 inch to 0.015 inch, 0.015 inch to 0.020 inch, or 0.020 to 0.025 inch. In other embodiments still, the lattice 140 depth can range from 0.006 inch to 0.011 inch, 0.007 inch to 0.012 inch, 0.008 inch to 0.013 inch, 0.009 inch to 0.014 inch, 0.01 inch to 0.015 inch, 0.011 to 0.016 inch, 0.012 to 0.017 inch, 0.013 to 0.018 inch, 0.014 inch to 0.019 inch, or 0.015 inch to 0.02 inch. For example, the lattice 140 depth can be 0.005, 0.006, 0.007, 0.008, 0.009, 0.01, 0.011, 0.012, 0.013, 0.014, 0.015, 0.016, 0.017, 0.018, 0.019, 0.02, 0.021, 0.022, 0.023, 0.024, or 0.025 inch.

The dimensions of the faceplate 130 can influence how the lattice stores energy in the faceplate. For example, the faceplate 130 comprises a thickness measured from the strike face 134 to the back face 138 in a direction perpendicular to the strike face 134. The faceplate 130 comprises a variable thickness profile extending between the faceplate center 132 and the faceplate perimeter 136. The faceplate 130 thickness varies from the faceplate center 132 to the faceplate perimeter 136. The variable thickness profile can comprise a thickened center region that encompasses the faceplate center 132, a thinned perimeter region adjacent the faceplate perimeter 136, and a transition region that varies the faceplate thickness between the thickened center region and the thinned perimeter region. The faceplate thickness can facilitate in reducing the weight of the faceplate and allow the weight to be moved to other portions of the club head (e.g. sole) to facilitate in center of gravity location or moment of inertia.

A thicker faceplate 130 can minimize the energy storage capabilities of the lattice 140 by restricting the flexing of the faceplate 130. A thinner faceplate 130 can increase the energy storage capabilities of the lattice 140 by allowing the faceplate 130 to freely flex. For example, the faceplate thickness near the faceplate center 132 can range from 0.075 inch to 0.2 inch. For example, the face thickness near the faceplate center 132 can range from 0.10 inch to 0.20, or 0.10 to 0.15 inch. In some embodiments, the faceplate thickness near the faceplate center 132 can range from 0.075 inch to 0.175 inch, or 0.075 inch to 0.15 inch. In other embodiments, the faceplate thickness near the faceplate center 132 can range from 0.08 inch to 0.175 inch, 0.08 inch to 0.15 inch, 0.09 inch to 0.175 inch, 0.09 inch to 0.15 inch. For example, the faceplate thickness near the faceplate center 132 can be 0.075, 0.08, 0.085, 0.09, 0.095, 0.097, 0.10, 0.102, 0.11, 0.12, 0.13, 0.135, 0.137, 0.14, 0.15, 0.16, 0.17, 0.18, 0.19, or 0.20 inch.

In another example, the faceplate thickness near the faceplate perimeter 136 can range from 0.06 inch to 0.14 inch. In some embodiments, the faceplate thickness near the faceplate perimeter 136 can range from 0.06 inch to 0.10 inch, 0.06 inch to 0.12 inch, 0.07 inch to 0.10 inch, or 0.07 inch to 0.12 inch. In some embodiments, the faceplate thickness near the faceplate perimeter 136 can range from 0.06 inch to 0.08 inch, 0.08 inch to 0.10 inch, 0.10 inch to 0.12 inch, or 0.12 inch to 0.14 inch. For example, the faceplate thickness near the faceplate perimeter 136 can be 0.06, 0.07, 0.075, 0.077, 0.08, 0.085, 0.09, 0.095, 0.10, 0.11, 0.12, 0.13, or 0.14 inch.

Lattice with Series of Interconnected Grooves

As discussed above, the lattice can comprise a plurality of flexure shapes. These flexure shapes can further comprise a series of interconnected grooves. The series of interconnected grooves can comprise a base groove and a plurality of ligament grooves extending outward from the base groove. The plurality of ligament grooves can be connected or integral with the base groove. The plurality of ligament grooves can be equally spaced along the base groove or unequally spaced. The series of interconnected grooves can comprise a repeating pattern of base grooves, and a repeating pattern of ligament grooves, where the repeating pattern of base grooves and ligament grooves are interconnected to from the flexure shapes. The flexure shapes can be formed from a portion of the base groove and the ligament grooves, where portions of the flexure shape are either concave or convex relative to a center of the flexure shape. The lattice having the flexure shapes formed from the series of interconnected grooves facilitates in storing greater energy in the faceplate to allow for greater ball speed during golf ball impacts. Described below are three examples of lattices comprising interconnected base grooves and ligament grooves.

Sunburst Grooves

In one example, as illustrated in FIG. 7, the faceplate 130 can comprise a lattice 240. The lattice 240 can be similar to lattice 140 as described above, but can differ in size, shape, or dimensions. The lattice 240 can comprise a plurality of sunburst grooves. Stated another way, the lattice 240 can comprise a plurality of grooves arranged in a sunburst pattern. Each sunburst groove can comprise a base groove 244, and six ligament grooves 248 extending from the base groove 244. The base groove 244 can be circular, and the ligament grooves 248 can be curved. The ligament grooves 248 can extend non-linearly outward or away from the base groove 244.

The ligament grooves 248 can comprise a first curve 252, a second curve 256, and an inflection point 260 positioned between the first curve 252 and the second curve 256. The position of the inflection point 260 indicates the change in direction of the ligament groove 248 curvature. In some embodiments, the first curve 252 and the second curve 256 of the ligament groove 248 can comprise similar widths. In other embodiments, the first curve 252 and the second curve 256 of the ligament groove 248 can comprise different widths.

The first curve 252 and the second curve 256 can comprise an outer radius. The outer radius of the first curve 252 and the second curve 256 can be similar or different. The outer radius of the first curve 252 and the second curve 256 can range from 0.08 to 0.16 inch. In some embodiments, the outer radius of the first curve 252 and the second curve 256 can range from 0.08 to 0.12 inch, or 0.12 to 0.16 inch. In some embodiments, the outer radius of the first curve 252 and the second curve 256 can range from 0.08 to 0.1 inch, 0.1 to 0.12 inch, 0.12 to 0.14 inch, or 0.14 to 0.16 inch. For example, the outer radius of the first curve 252 and the second curve 256 can be 0.05, 0.06, 0.07, 0.08, 0.09, 0.1, 0.11, 0.12, 0.13, 0.14, or 0.15 inch.

The first curve 252 and the second curve 256 can comprise an inner radius. The inner radius is less than the outer radius. Stated another way, the outer radius is greater than the inner radius. The inner radius of the first curve 252 and the second curve 256 can be similar or different. The inner radius of the first curve 252 and the second curve 256 can range from 0.03 to 0.09 inch. In some embodiments, the inner radius of the first curve 252 and the second curve 256 can range from 0.03 to 0.06 inch, or 0.06 to 0.09 inch. For example, the inner radius of the first curve 252 and the second curve 256 can be 0.03, 0.04, 0.05, 0.06, 0.07, 0.075 0.08, or 0.09 inch.

As illustrated in FIG. 7, at least three sunburst grooves form a flexure shape 268. The flexure shape 268 can comprise a portion of at least three base grooves 244 and at least three ligament grooves 248. A portion of the circular base groove 244 and the curved ligament grooves 248 form the reentrant shape of the flexure shape 268, where portions of the flexure shape 268 are concave or convex relative to a center of the flexure shape 268. Further, adjacent flexure shapes 268 can share at least one ligament groove 248, where the shared ligament groove 248 forms a portion of two flexure shapes 268.

As illustrated in FIG. 7, the lattice 240 can comprise a repeating pattern of sunburst grooves, where the flexure shapes 268 are interspersed with circular shapes (i.e. base grooves 244). Stated another way, the lattice 240 can comprise a first repeating pattern of flexure shapes 268, and a second repeating pattern of circular shapes, where the first repeating pattern is interspersed in the second repeating pattern. Further, stated another way, the lattice 240 can comprise a repeating pattern of interconnected flexure shapes 268.

The dimensions of the lattice 240 can influence how the lattice stores energy in the faceplate 130. For example, the base groove 244 can comprise an outer diameter. The outer diameter of the base groove 244 can range from 0.1 to 0.3 inch. In some embodiments, the outer diameter of the base groove 244 can range from 0.1 to 0.2 inch, or 0.2 to 0.3 inch. For example, the outer diameter of the base groove 244 can be 0.10, 0.11, 0.12, 0.13, 0.14, 0.15, 0.16, 0.17, 0.18, 0.19, 0.2, 0.25, or 0.30 inch.

The base groove 244 can comprise an inner diameter. The inner diameter of the base groove 244 can range from 0.05 to 0.2 inch. In some embodiments, the inner diameter of the base groove 244 can range from 0.05 to 0.125 inch, or 0.125 to 0.2 inch. For example, the inner diameter of the base groove 244 can be 0.05, 0.1, 0.11, 0.12, 0.13, 0.14, 0.15, 0.16, 0.17, 0.18, 0.19, or 0.2 inch.

Referring to FIG. 18, the lattice 240 can be aligned in a low-toe to high-heel direction, a low-heel to high-toe direction, a horizontal direction, a vertical direction, or any combination thereof. As illustrated in FIG. 18, the lattice 240 can be aligned or oriented in the low-heel to high-toe direction. The alignment direction of the lattice 240 can impact the characteristic time of the face within the center region 150, the peripheral region 154, the toe region 158, the heel region 162, the bottom region 166, the top region 170, the high-toe region 174, the low-toe region 178, the high-heel region 182, and/or the low-heel region 186. Furthermore, in some embodiments, the lattice 240 is aligned to match the average shot dispersion across a faceplate. The lattice 240 location can correspond to regions of the face that endure the most impacts. The ability of the lattice to distribute stress can result in greater durability, particularly within area that experiences the greatest number of hits. Thus, the lattice alignment direction can be selected to increase the uniformity of the characteristic time response across the face 130 and to increase durability.

As illustrated in FIG. 18, in some embodiments, the lattice 240 can formed as a circular region, an elliptical region, or a combination thereof, centered around the geometric center 132 of the faceplate 130. As illustrated in FIG. 18, the lattice 240 can also be formed as a elliptical region aligned in the low-heel to high-toe direction. Further, the lattice 240 can be formed as a circular and elliptical region aligned in the low-heel to high-toe direction.

The faceplate 130 comprising lattice 240 can adjust characteristic time within USGA regulations. The faceplate 130 comprising the lattice 240 reduces characteristic time while maintaining similar ball speed performance when compared to a similar faceplate devoid of the lattice 240. In some examples, the faceplate 130 comprising the lattice 240 decreases center CT by about 1 to 10 μs, or 1 to 5 μs when compared to a similar faceplate devoid of the lattice 240. The faceplate 130 comprising the lattice 240 maintains similar ball performance compared to the similar faceplate devoid of the lattice 240. The faceplate 130 comprising the lattice 240 provides desirable, lower characteristic time values while not sacrificing high ball speed performance.

Chiral Grooves

In another example, as illustrated in FIG. 8, the faceplate 130 can comprise a lattice 340. The lattice 340 can be similar to lattice 140 as described above, but can differ in size, shape, or dimensions. The lattice 340 can comprise a plurality of chiral grooves. Stated another way, the lattice 340 can comprise a plurality of grooves arranged in chiral pattern. Each chiral groove can comprise a base groove 344, and six ligament grooves 348 extending from the base groove 344. Lattice 340 can be similar to lattice 240, but differ in ligament groove geometry. The base groove 344 can be circular, and the ligament grooves 348 can be linear. The ligament grooves 348 can extend linearly outward from the base groove 344, where the ligament grooves 348 can be tangent to the circular base groove 348.

As illustrated in FIG. 8, three chiral grooves form a flexure shape 368. The flexure shape 368 can comprise a portion of at least three base grooves 344 and at least three ligament grooves 348. A portion of the circular base groove 344 forms the reentrant shape of the flexure shape 368, where portions of the flexure shape 368 are concave relative to a center of the flexure shape 368. Further, adjacent flexure shapes 368 can share at least one ligament groove 348, where the shared ligament groove 348 forms a portion of two flexure shapes 368.

The dimensions of the lattice 340 can influence how the lattice stores energy in the faceplate 130. For example, the base groove 344 can comprise an outer diameter. The outer diameter of the base groove 344 can range from 0.1 to 0.3 inch. In some embodiments, the outer diameter of the base groove 344 can range from 0.1 to 0.2 inch, or 0.2 to 0.3 inch. For example, the outer diameter of the base groove 344 can be 0.10, 0.11, 0.12, 0.13, 0.14, 0.15, 0.16, 0.17, 0.18, 0.19, 0.2, 0.25, or 0.30 inch.

The base groove 344 can comprise an inner diameter. The inner diameter of the base groove 344 can range from 0.05 to 0.2 inch. In some embodiments, the inner diameter of the base groove 344 can range from 0.05 to 0.125 inch, or 0.125 to 0.2 inch. For example, the inner diameter of the base groove 344 can be 0.05, 0.1, 0.11, 0.12, 0.13, 0.14, 0.15, 0.16, 0.17, 0.18, 0.19, or 0.2 inch.

Windmill Grooves

In another example, as illustrated in FIG. 9, the faceplate 130 can comprise a lattice 440. The lattice 440 can be similar to lattice 140 as described above, but can differ in size, shape, or dimensions. The lattice 440 can comprise a plurality windmill grooves. Stated another way, the lattice 440 can comprise a plurality of grooves arranged in a windmill pattern. Each windmill groove can comprise four ligament grooves 448 that meet or converge at a base point 444. The ligament grooves 448 can extend away from the base point 444, where a right angle (i.e. approximately 90 degrees) forms between adjacent ligament grooves 448. Each ligament groove 448 extends away from the base point 444 to an inflection point 460, where each ligament groove 448 changes direction at the inflection point 460.

Each ligament groove 448 can comprise a first segment 452, a second segment 456, and the inflection point 460 positioned between the first segment 452 and the second segment 456. The position of the inflection point 460 indicates the change in direction of the ligament groove 448. The inflection point 460 can define a right angle (i.e. approximately 90 degrees) between the first segment 452 and the second segment 456 of the ligament groove 448. In some embodiments, the first segment 452 and the second segment 456 of the ligament groove 448 can comprise similar widths. In other embodiments, the first segment 452 and the second segment 456 of the ligament groove 448 can comprise different widths.

As illustrated in FIG. 9, four windmill grooves can form a flexure shape 468. The flexure shape 468 can comprise eight ligament grooves 448. The ligament grooves 448 form the reentrant shape of the flexure shape 468, where portions of the flexure shape 468 are concave or convex relative to a center of the flexure shape 468. Further, adjacent flexure shapes 468 can share at least two ligament grooves 448, where the shared ligament grooves 448 form a portion of two flexure shapes 468.

The dimensions of the lattice 240, 340, and 440 can influence how the lattice stores energy in the faceplate 130. For example, as illustrated in FIGS. 7 and 8, the base grooves 244 and 344 can comprise a width (hereafter "base groove width"). The base groove width can range from 0.01 inch to 0.1 inch. In some embodiments, the base groove width can range from 0.01 inch to 0.05 inch, or 0.05 inch to 0.1 inch. In some embodiments, the base groove width can range from 0.01 to 0.03 inch, 0.01 to 0.04 inch, 0.01 to 0.05 inch, 0.01 to 0.06 inch, 0.01 to 0.07 inch, 0.01 to 0.08 inch, or 0.01 to 0.09 inch. For example, the base groove width can be 0.01, 0.02, 0.03, 0.04, 0.05, 0.06, 0.07, 0.08, 0.09, or 0.1 inch.

In another example, as illustrated in FIG. 7-9, the ligament grooves 248, 348, and 448 can comprise a width (hereafter "ligament groove width"). The ligament groove width can be the same or different than the base groove width. For example, the ligament groove width can be greater than the base groove width. In another example, the ligament groove width can be less than the base groove width. In some embodiments, the base groove width can range from 0.01 inch to 0.05 inch, or 0.05 inch to 0.1 inch. In some embodiments, the ligament groove width can range from 0.01 to 0.03 inch, 0.01 to 0.04 inch, 0.01 to 0.05 inch, 0.01 to 0.06 inch, 0.01 to 0.07 inch, 0.01 to 0.08 inch, or 0.01 to 0.09 inch. For example, the ligament groove width can be 0.01, 0.02, 0.03, 0.04, 0.05, 0.06, 0.07, 0.08, 0.09, or 0.1 inch.

The dimensions, the shape, and the pattern of the lattice 240, 340, and 440 (hereafter "the lattice") formed from a series of interconnected grooves affects faceplate bending during golf ball impacts. During golf ball impacts, the flexure shapes of the lattice resemble springs storing energy through tension and torsion loads. As the golf ball impacts the faceplate, the strike face is in compression and the back face is in tension. As tension is applied to the back face, the convex and concave curves of the flexure shape ligament grooves flex and act as springs that store energy in the faceplate through linear and torsional bending (i.e. similar to a spring storing energy through tension and torsion). Storing energy through two modes of bending is advantageous over conventional club head faceplates that store energy through one mode of bending (i.e. linear bending). Storing energy though two modes of bending allows for greater ball speeds during golf ball impacts.

Further, the flexure shapes of the lattice reduce the largest stresses concentrated in a small volume of the faceplate material (i.e. impact area of the faceplate) by displacing the reduced stress over a greater volume of the faceplate material. For example, the reduced stress can be displaced over 3 to 8 base grooves or ligament grooves in a direction from near the faceplate center 132 to near the faceplate perimeter 136 in the lattice 240, 340, or 440. In some embodiments, the reduced stress can be displaced over 3 to 5, 4 to 6, 5 to 7, or 6 to 8 base grooves or ligament grooves in a direction from near the faceplate center 132 to near the faceplate perimeter 136. This reduction of stress does not occur in a faceplate devoid of the lattice 240, 340, or 440.

Lattice with Flexure Shape Recesses

Flexure Shape Recesses with Vertices

As discussed above, the lattice can comprise a plurality of flexure shapes that are formed from a plurality of land portions. The plurality of land portions can form a plurality of flexure shape recesses, where the land portions separate the flexure shape recesses. The land portions are interconnected with one another and define the portions of the club head 100 that are devoid of the flexure shape recesses. The land portions form a perimeter of the flexure shape recesses.

The land portions can comprise a width between adjacent flexure shape recesses. The land portion width can be measured from a flexure shape recess perimeter to an adjacent flexure shape recess perimeter. The land portion width can vary or remain constant between adjacent flexure shape recesses. Adjacent land portion widths can be similar or different from each other. For example, the land portion width can remain constant along one portion of the flexure shape recess perimeter, and the land portion width can vary along another portion of the flexure shape recess perimeter.

In some embodiments, the land portion width can be greater than 0.02 inch, greater than 0.05 inch, greater than 0.1 inch, greater than 0.15 inch, or greater than 0.2 inch. In some embodiments, the land portion width can range from 0.02 to 0.2 inch. In some embodiments, the land portion width can range from 0.02 to 0.1 inch, or 0.1 to 0.2 inch. In some embodiments, the land portion width can range from 0.02 to 0.05 inch, 0.05 to 0.08 inch, 0.08 to 0.11 inch, 0.11 to 0.14 inch, 0.14 to 0.17 inch, or 0.17 to 0.2 inch. For example, the land portion width can be 0.02, 0.03, 0.04, 0.05, 0.06, 0.08, 0.09, 0.1, 0.11, 0.12, 0.13, 0.14, 0.15, 0.16, 0.17, 0.18, 0.19, or 0.2 inch.

The flexure shape recess can comprise a width. The flexure shape recess width can be greater than 0.08 inch, greater than 0.1 inch, greater than 0.12 inch, greater than 0.14 inch, greater than 0.16 inch, greater than 0.18 inch, or greater than 0.2 inch. In some embodiments, the flexure shape recess width can range from 0.1 to 0.3 inch. In some embodiments, the flexure shape recess width can range from 0.1 to 0.2, or 0.2 to 0.3 inch. For example, the flexure shape recess width can be 0.1, 0.11, 0.12, 0.125, 0.13, 0.14, 0.15, 0.16, 0.17, 0.18, 0.19, 0.2, 0.25, or 0.3 inch.

The perimeter of the flexure shape recess can comprise at least two vertices that define acute interior angles, and at least one vertex defining a reflex angle. The at least one reflex angle vertex is positioned between the at least two acute interior angle vertices. The at least one reflex angle vertex does not define an acute interior angle. The acute interior angle can define an angle less than 90 degrees, and the reflex angle can define an angle greater than 180 degrees and less than 360 degrees. In some embodiments, the reflex angle can define an angle greater than 180 degrees and less than 270 degrees, or greater than 270 degrees and less 360 degrees. In other embodiments, the reflex angle can define an angle greater than 180 degrees and less than 225 degrees, greater than 225 degrees and less than 270 degrees, greater than 270 degrees and less than 315 degrees, or greater than 315 degrees and less than 360 degrees. The at least one reflex angle vertex on the flexure shape recess perimeter can define the reentrant, concave, or non-convex shape.

In some embodiments, the flexure shape recess can comprise one, two, three, four, five, or six vertices defining the reflex angle greater than 180 degrees and less than 360 degrees. The number of reflex angle vertices can correspond with the concavity of the flexure shape recess. For example, a flexure shape recess comprising two reflex angle vertices can comprise two concave portions along the flexure shape recess perimeter. In another example, a flexure shape recess comprising one reflex angle vertex can comprise one concave portion along the flexure shape recess perimeter. In another example, the flexure shape recess comprising three reflex angle vertices can comprise three concave portions along the flexure shape recess perimeter. In another example, the flexure shape recess comprising four reflex angle vertices can comprise four concave portions along the flexure shape recess perimeter. Further, in another example, the flexure shape recess comprising six reflex angle vertices can comprise six concave portions along the flexure shape recess perimeter.

The lattice comprising the flexure shape recesses formed from the plurality of land portions facilitates in storing greater energy in the faceplate to allow for greater ball speed during golf ball impacts. Described below are a few examples of lattices comprising land portions and flexure shape recesses. The flexure shape recess examples described below are in reference to one orientation, but it would be appreciated that the flexure shape recesses can be oriented in several different configurations to achieve greater faceplate energy storage and greater ball speed during golf ball impacts. Further, it would be appreciated that the vertices on the flexure shape recess perimeter can be rounded or comprise a small radius to round off any sharp edges on the flexure shape recess perimeter to minimize stress concentrations in the faceplate 130.

Evan Flexure Shape Recess

Figure 10:
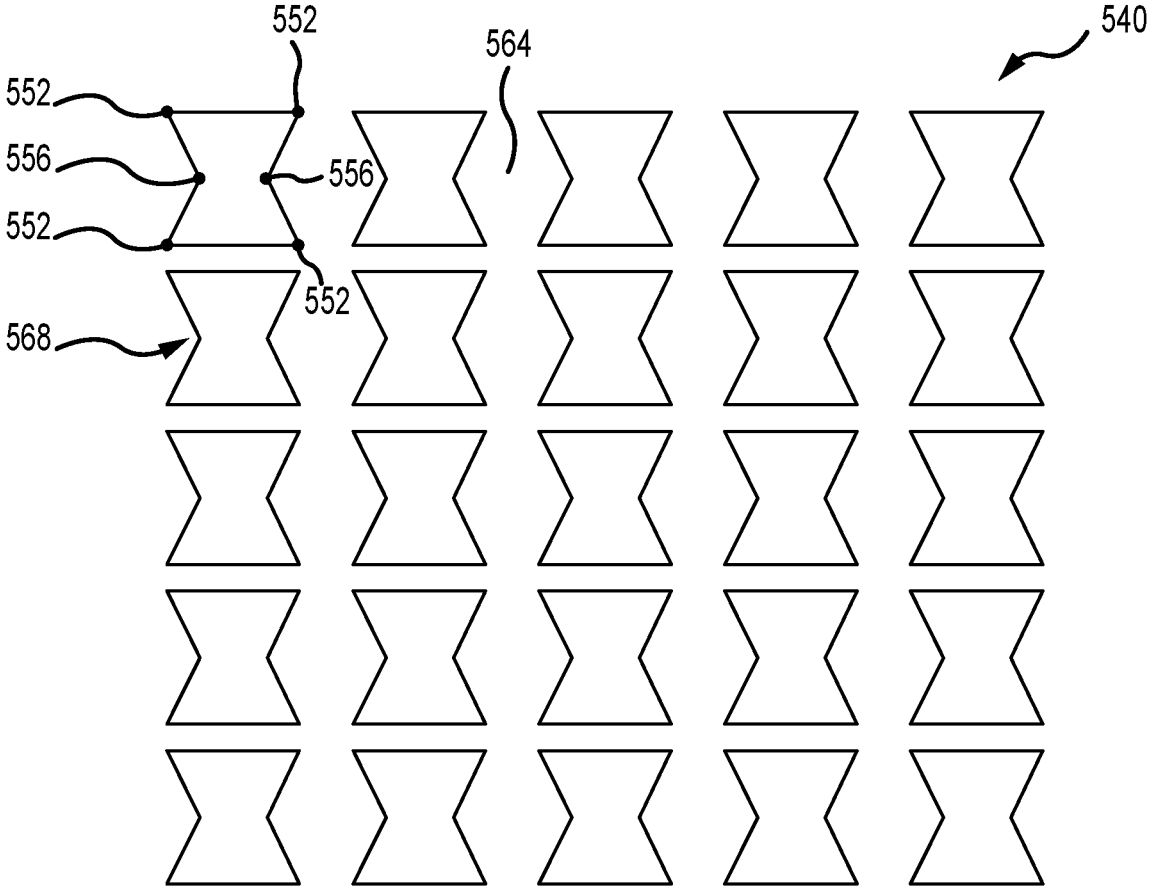
FIG. 10 illustrates a portion of a Evan flexure shape recess faceplate lattice.

In one example, as illustrated in FIG. 10, the faceplate 130 can comprise a lattice 540. The lattice 540 can be similar to lattice 140 as described above, but can differ in size, shape, or dimensions. A plurality of land portions 564 can form a plurality of Evan flexure shape recesses 568. Each Evan flexure shape recess 568 can comprise four vertices 552 that define acute interior angles, and two vertices 556 that define reflex angles.

As illustrated in FIG. 10, the Evan flexure shape recesses 568 can comprise a bow tie shape, where a width of the Evan flexure shape recess 568 decreases from the acute interior angle vertices 552 to the reflex angle vertices 556. Stated another way, the width of the Evan flexure shape recess 568 is greater between opposite acute interior angle vertices 552 than between opposite reflex angle vertices 556. A minimum width of the Evan flexure shape recess 568 can measured across opposite reflex angle vertices 556. As described above, the width of the Evan flexure shape recess 568 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the Evan flexure shape recess 568 can range from 0.1 to 0.3 inch. In one example, the width of the Evan flexure shape recess 568 can be 0.125 inch.

The width of the land portions 564 can correspond with the width of the Evan flexure shape recess 568. In this example, the width of the land portions 564 can vary along a portion of the perimeter of the Evan flexure shape recess 568. More specifically, the width of the land portions 564 between adjacent Evan flexure shape recesses 568 increases from the acute interior angle vertices 552 to the reflex angle vertices 556. Stated another way, the width of the land portions 564 between adjacent Evan flexure shape recesses 568 is greater at the reflex angle vertices 556 than at the acute interior angle vertices 552. Further, stated another way, the width of the land portions 564 between adjacent Evan flexure shape recesses 568 is less at the acute interior angle vertices 552 than at the reflex angle vertices 556. In this example, the width of the land portions 564 along another portion of the perimeter of the Evan flexure shape recess 568 can remain constant.

Further, as described above, the width of the land portion 564 can be greater than 0.02 inch, greater than 0.05 inch, greater than 0.1 inch, greater than 0.15 inch, or greater than 0.2 inch. In some embodiments, as described above, the width of the land portion 564 can range from 0.02 to 0.2 inch.

Arrowhead Flexure Shape Recess

Figure 11:
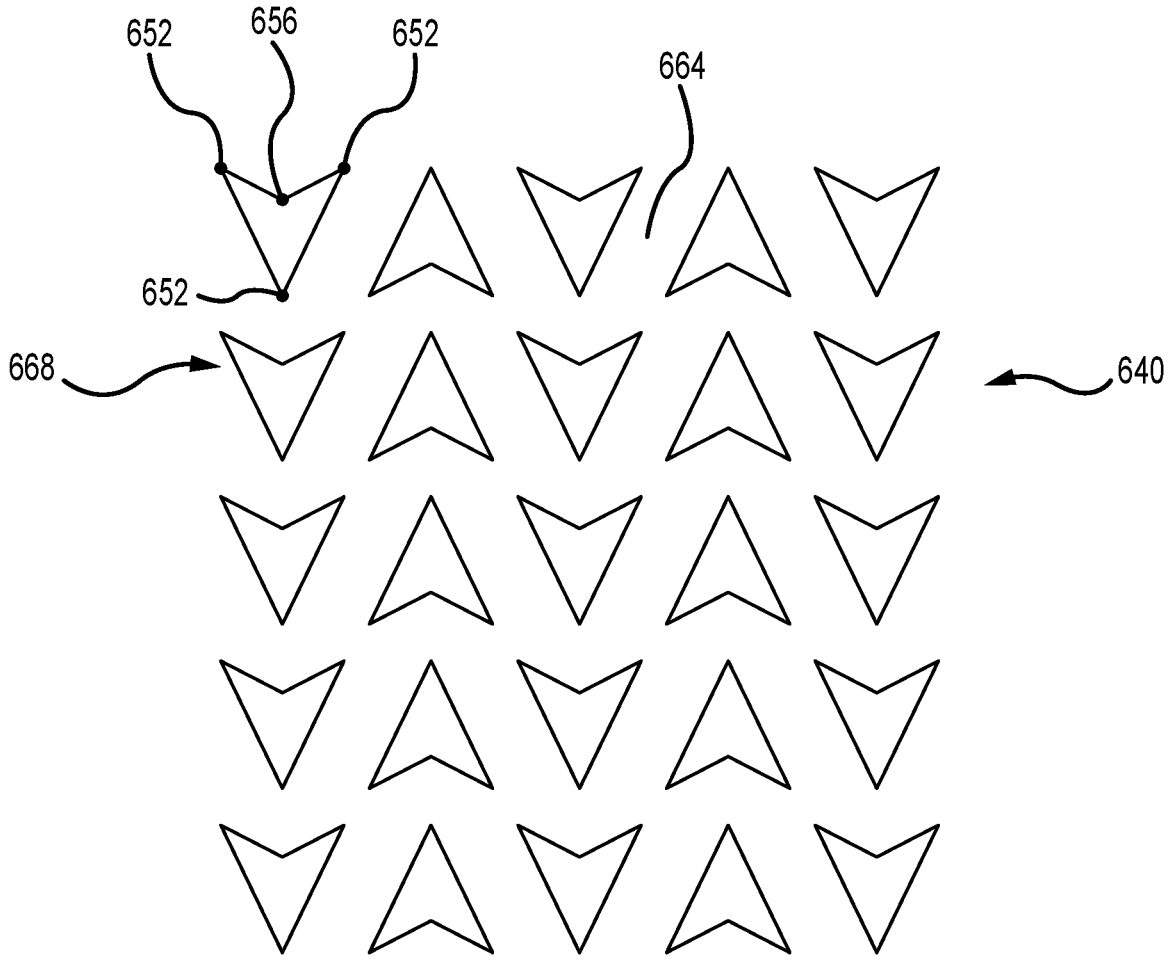
FIG. 11 illustrates a portion of a arrowhead flexure shape recess faceplate lattice.

In another example, as illustrated in FIG. 11, the faceplate 130 can comprise a lattice 640. The lattice 640 can be similar to lattice 140 as described above, but can differ in size, shape, or dimensions. A plurality of land portions 664 can from a plurality of arrowhead flexure shape recesses 668. Each arrowhead flexure shape recess 668 can comprise three vertices 652 that define acute interior angles, and one vertex 656 that defines a reflex angle.

As illustrated in FIG. 11, the arrowhead flexure shape recess 668 can comprise a substantially triangular shape or arrowhead shape. A minimum width of the arrowhead flexure shape recess 668 can be measured between the reflex angle vertex 656 and an acute interior angle vertex 652 directly opposite the reflex angle vertex 656 (i.e. an acute interior angle vertex 652 that is not adjacent the reflex angle vertex 656). As described above, the width of the arrowhead flexure shape recess 668 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the arrowhead flexure shape recess 668 can range from 0.1 to 0.3 inch. In one example, the width of the arrowhead flexure shape recess 668 can be 0.125 inch.

The width of land portions 664 can correspond with the width of the arrowhead flexure shape recess 668. In this example, the width of the land portions 664 can remain constant along a portion of the perimeter of the arrowhead flexure shape recess 668, and the width of the land portions 664 can vary along another portion of the perimeter of the arrowhead flexure shape recess 668.

Further, as described above, the width of the land portion 664 can be greater than 0.02 inch, greater than 0.05 inch, greater than 0.1 inch, greater than 0.15 inch, or greater than 0.2 inch. In some embodiments, as described above, the width of the land portion 664 can range from 0.02 to 0.2 inch.

Four-Pointed Star Flexure Shape Recess

Figure 12:
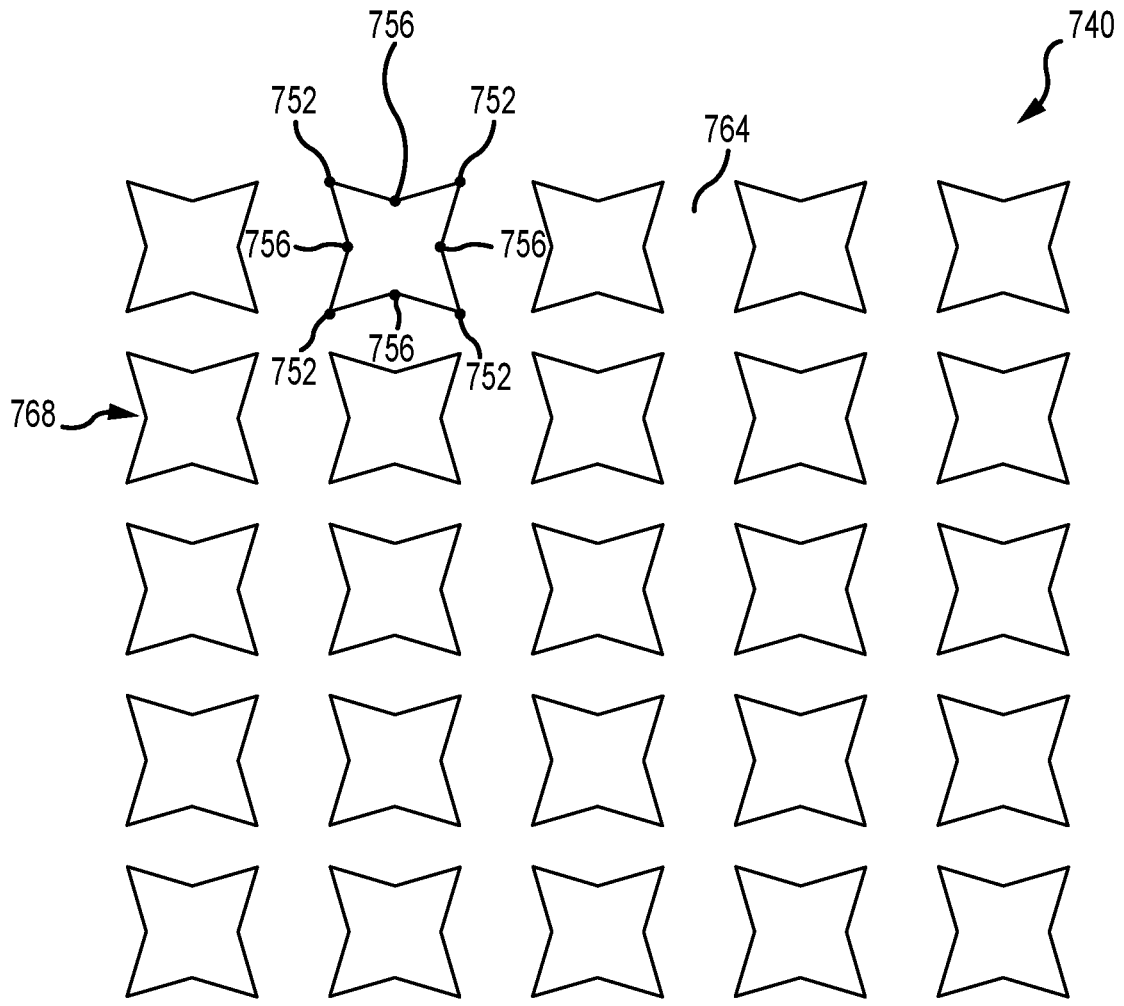
FIG. 12 illustrates a portion of a four-pointed star flexure shape recess faceplate lattice.

In another example, as illustrated in FIG. 12, the faceplate 130 can comprise a lattice 740. The lattice 740 can be similar to lattice 140 as described above, but can differ in size, shape, or dimensions. A plurality of land portions 764 can form a plurality of four-pointed star flexure shape recesses 768. Each four-pointed star flexure shape recess 768 can comprise four vertices 752 that define acute interior angles, and four vertices 756 that define reflex angles.

As illustrated in FIG. 12, the four-pointed star flexure shape recess 768 can comprise a star shape or a concave square shape. A minimum width of the four-pointed star flexure shape recess 768 can be measured between opposite reflex angle vertices 756. A maximum width of the four-pointed star flexure shape recess 768 can be measured between opposite acute interior angle vertices 752 (i.e. acute interior angle vertices 752 having the recess or void between them). As described above, the width of the four-pointed flexure shape recess 768 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the four-pointed flexure shape recess 768 can range from 0.1 to 0.3 inch. In one example, the width of the four-pointed flexure shape recess 768 can be 0.125 inch.

The width of the land portions 764 can correspond with the width of the four-pointed star flexure shape recess 768. In this example, the width of the land portions 764 can vary along a portion of the perimeter of the four-pointed star flexure shape recess 768. More specifically, the width of the land portions 764 between adjacent four-pointed star flexure shape recesses 768 increases from the acute interior angle vertices 752 to the reflex angle vertices 756. Stated another way, the width of the land portions 764 is greater at the reflex angle vertices 756 than at the acute interior angle vertices 752. Further, stated another way, the width of the land portions 764 is less at the acute interior angle vertices 752 than at the reflex angle vertices 756.

Further, as described above, the width of the land portion 764 can be greater than 0.02 inch, greater than 0.05 inch, greater than 0.1 inch, greater than 0.15 inch, or greater than 0.2 inch. In some embodiments, as described above, the width of the land portion 764 can range from 0.02 to 0.2 inch.

Six-Pointed Star Flexure Shape Recess

Figure 13:
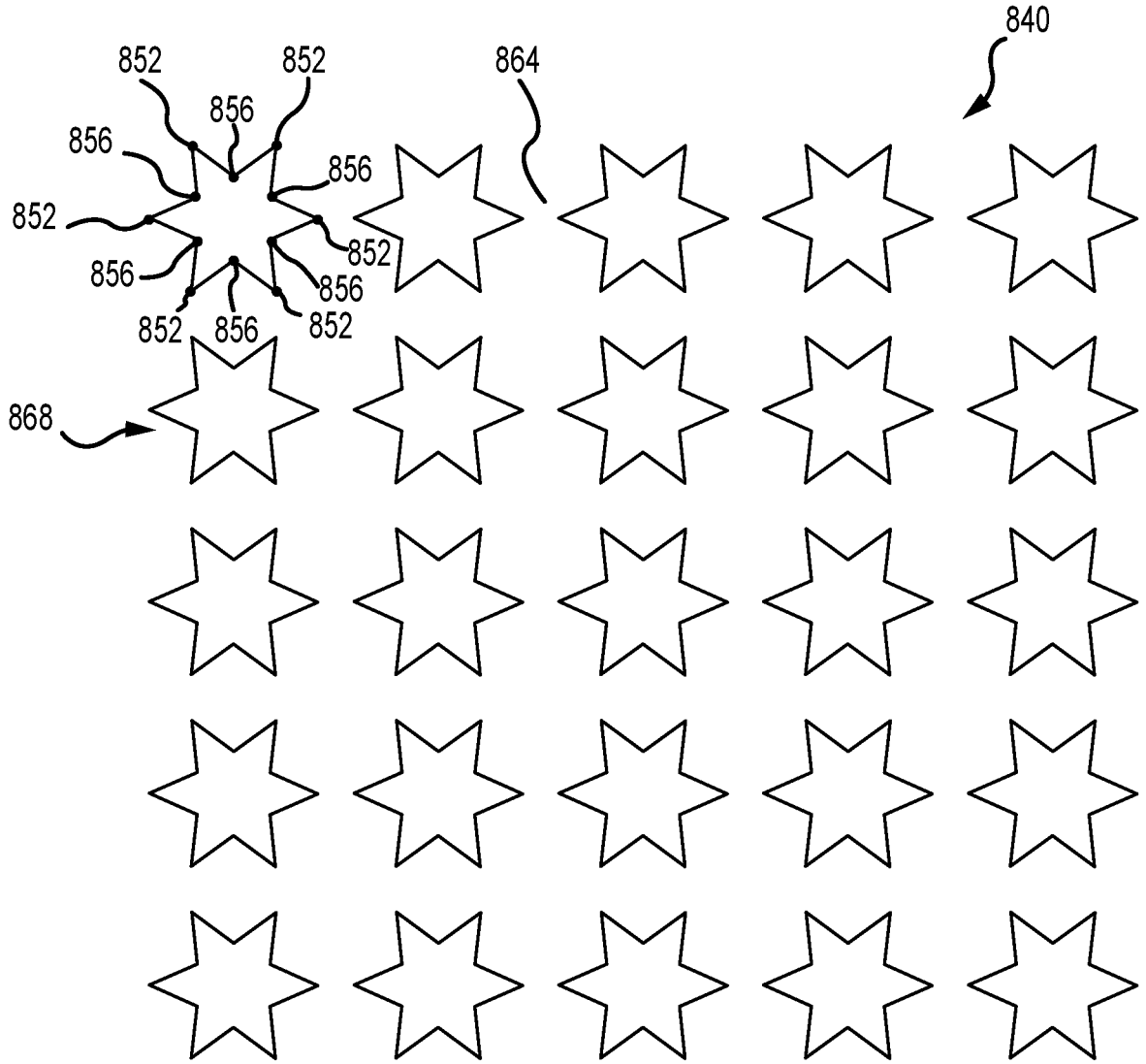
FIG. 13 illustrates a portion of a six-pointed star flexure shape recess faceplate lattice.

In another example, as illustrated in FIG. 13, the faceplate 130 can comprise a lattice 840. The lattice 840 can be similar to lattice 140 as described above, but can differ in size, shape, or dimensions. A plurality of land portions 864 can form a plurality of six-pointed star flexure shape recesses 868. Each six-pointed star flexure shape recess 768 can comprise six vertices 852 that define acute interior angles, and six vertices 856 that define reflex angles.

As illustrated in FIG. 13, the six-pointed star flexure shape recess 868 can comprise a star shape. A minimum width of the six-pointed star flexure shape recess 868 can be measured between opposite reflex angle vertices 856 (i.e. reflex angle vertices 856 having the recess or void between them). A maximum width of the six-pointed star flexure shape recess 868 can be measured between opposite acute interior angle vertices 852 (i.e. acute interior angle vertices 852 having the recess or void between them). As described above, the width of the six-pointed star flexure shape recess 868 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the six-pointed star flexure shape recess 868 can range from 0.1 to 0.3 inch. In one example, the width of the six-pointed star flexure shape recess 868 can be 0.125 inch.

The width of the land portions 864 can correspond with the width of the six-pointed star flexure shape recess 868. In this example, the width of the land portions 864 can vary along a portion of the perimeter of the six-pointed star flexure shape recess 868. More specifically, the width of the land portions 864 between adjacent six-pointed star flexure shape recesses 868 increases from the acute interior angle vertices 852 to the reflex angle vertices 856. Stated another way, the width of the land portions 864 between adjacent six-pointed star flexure shape recesses 868 is greater at the reflex angle vertices 856 than at the acute interior angle vertices 852. Further, stated another way, the width of the land portions 864 between adjacent six-pointed star flexure shape recesses 868 is less at the acute interior angle vertices 852 than at the reflex angle vertices 856.

Further, as described above, the width of the land portion 864 can be greater than 0.02 inch, greater than 0.05 inch, greater than 0.1 inch, greater than 0.15 inch, or greater than 0.2 inch. In some embodiments, as described above, the width of the land portion 864 can range from 0.02 to 0.2 inch.

Three-Pointed Star Flexure Shape Recess

Figure 14:
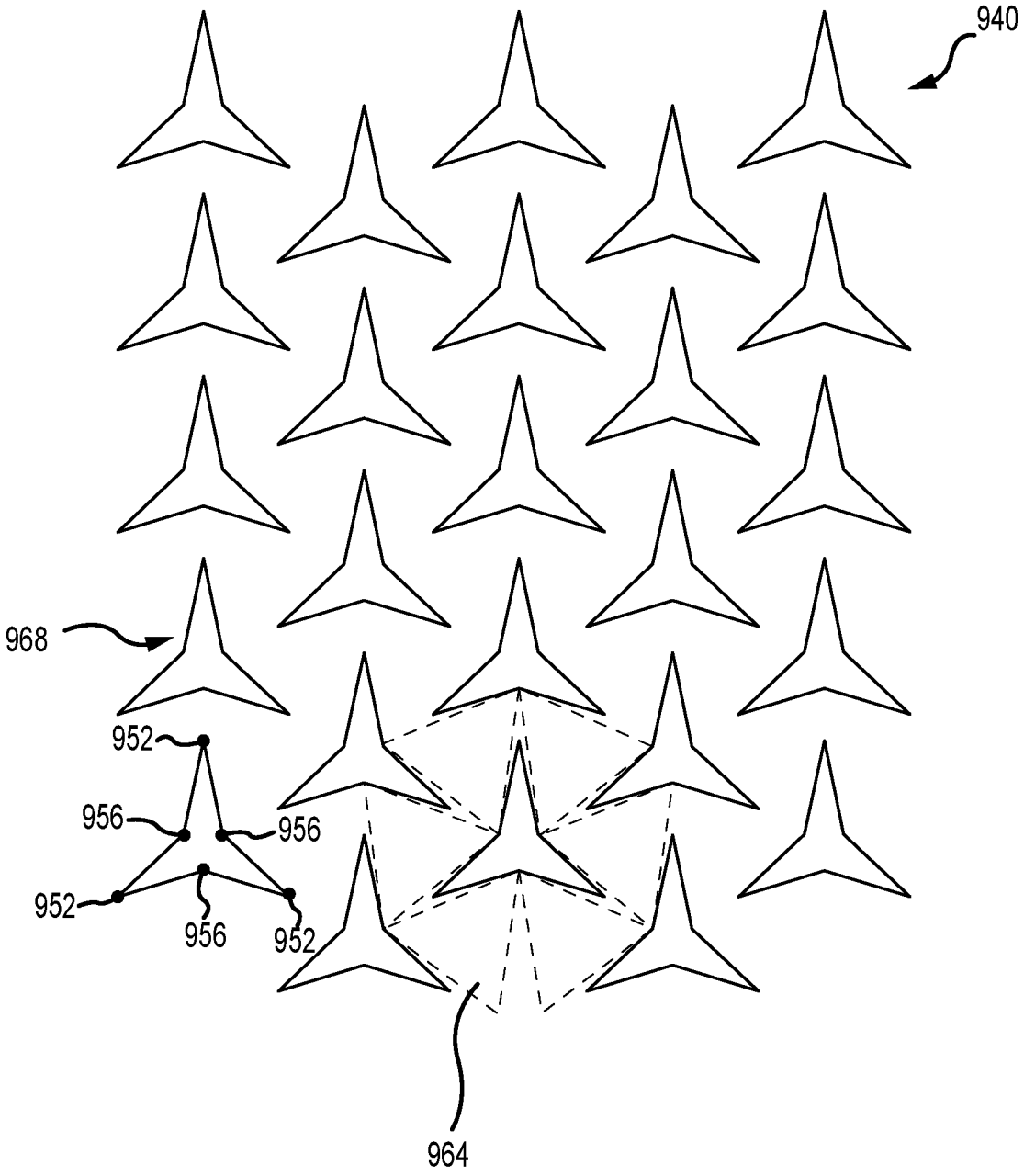
FIG. 14 illustrates a portion of a three-pointed star flexure shape recess faceplate lattice.

In another example, as illustrated in FIG. 14, the faceplate 130 can comprise a lattice 940. The lattice 940 can be similar to lattice 140 described above, but can differ in size, shape, or dimensions. A plurality of land portions 964 can form a plurality of three-pointed star flexure shape recesses 968. Each three-pointed star flexure shape recess 968 can comprise three vertices 952 that define acute interior angles, and three vertices 756 that define reflex angles.

As illustrated in FIG. 14, the three-pointed star flexure shape recess 968 can comprise a substantially triangular shape, star shape, or Y-shape. A minimum width of the three-pointed star flexure shape recess 968 can be measured between opposite reflex angle vertices 956 (i.e. reflex angle vertices 956 having the recess or void between them). A maximum width of the three-pointed star flexure shape recess 968 can be measured between an acute interior angle vertex 952 and a reflex angle vertex 956 (i.e. between an acute interior angle vertex 952 and a reflex angle vertex 956 having the recess or void between them). As described above, the width of the three-pointed star flexure shape recess 968 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the three-pointed flexure shape recess 968 can range from 0.1 to 0.3 inch. In one example, the width of the three-pointed flexure shape recess 968 can be 0.125 inch.

The width of the land portions 964 can correspond with the width of the three-pointed star flexure shape recess 968. In this example, the width of the land portions 964 can vary along a portion of the perimeter of the three-pointed star flexure shape recess 968. More specifically, the minimum width of the land portions 964 can be measured between the reflex angle vertex 956 on a flexure shape recess 968 and the acute interior angle vertex 952 on an adjacent flexure shape recess 968.

Further, as described above, the width of the land portion 964 can be greater than 0.02 inch, greater than 0.05 inch, greater than 0.1 inch, greater than 0.15 inch, or greater than 0.2 inch. In some embodiments, as described above, the width of the land portion 964 can range from 0.02 to 0.2 inch.

Bone Flexure Shape Recess

Figure 19:
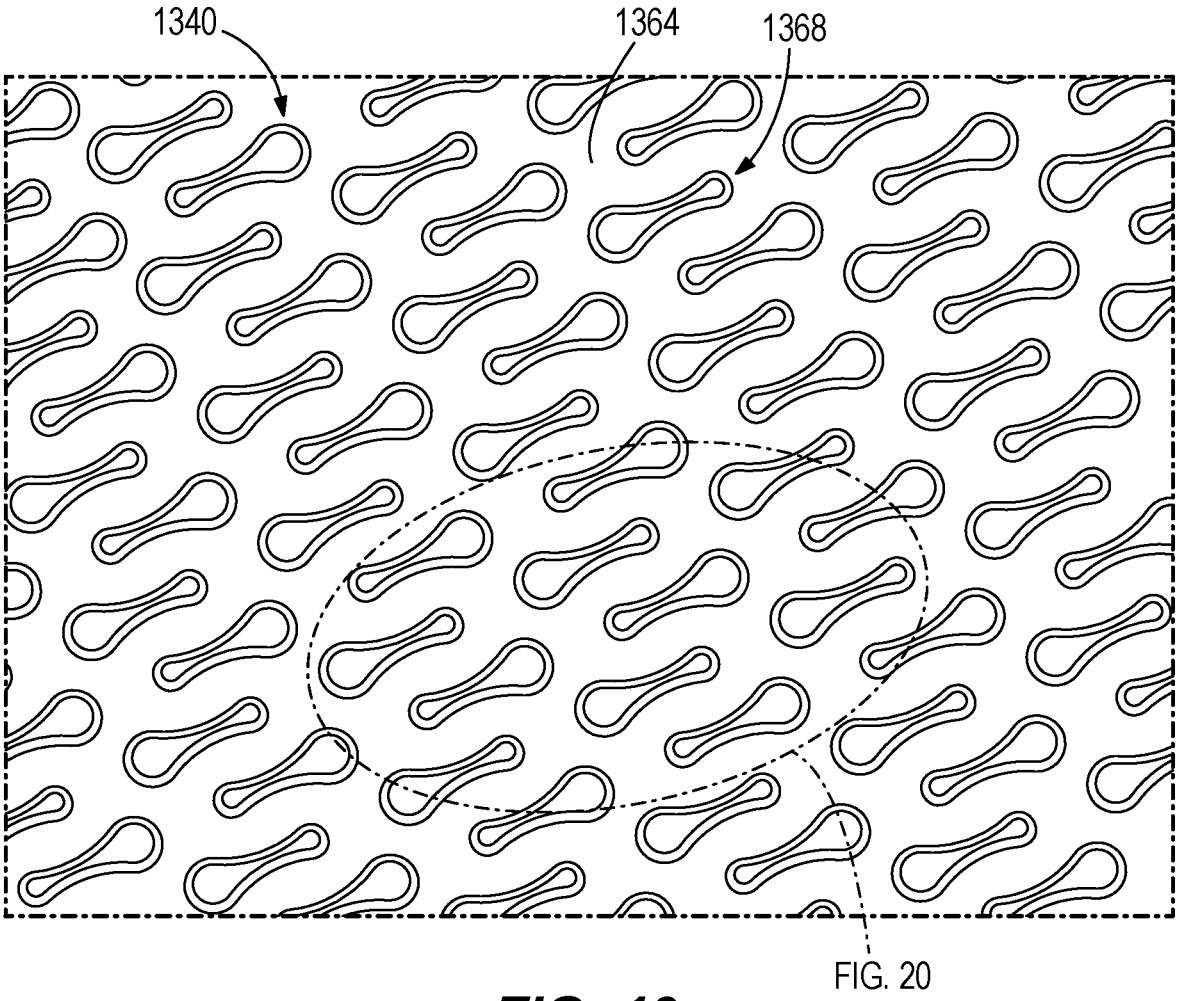
FIG. 19 illustrates a portion of a bone flexure shape recess faceplate lattice.
Figure 20:
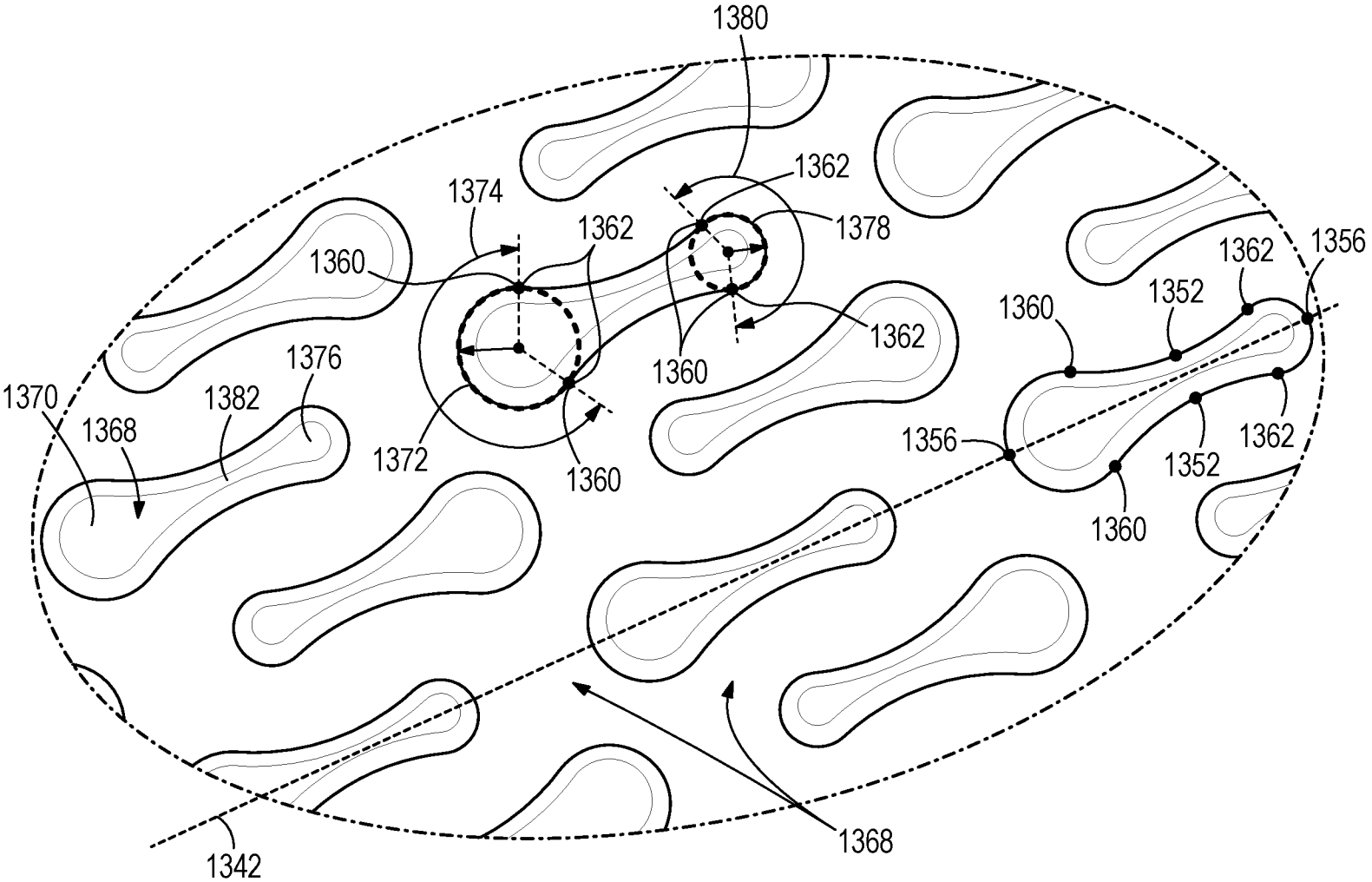
FIG. 20 illustrates a detailed view of the bone flexure shape recess faceplate lattice of FIG. 19.

In another example, as illustrated in FIGS. 19-21, the faceplate 130 can comprise a lattice 1340. The lattice 1340 can be similar to lattice 140 described above, but can differ in size, shape, or dimensions. A plurality of land portions 1364 can form a plurality of bone flexure shape recesses 1368. The plurality of bone flexure shape recesses 1368 are separate and not connected with adjacent bone flexure shape recesses 1368. Each bone flexure shape recess 1368 can comprise a perimeter edge having a plurality of concave and convex edges relative to a center of the bone flexure shape recess 1368. Further, each bone flexure shape recess 1368 can comprise a plurality of concave and convex edges relative to a centerline 1342. The centerline 1342 is defined as extending through a center of the bone flexure shape recess 1368 or extending between two central vertices of the bone flexure shape recess 1368.

Referring to FIGS. 19 and 20, the bone flexure shape recess 1368 can comprise a plurality of vertices along the perimeter edge of the bone flexure shape recess 1368. In one example, each bone flexure shape recess 1368 can comprise two vertices 1352 that define nadirs of two concave edges, and two vertices 1356 that define apexes of two convex edges. Described another way, the two vertices 1356 can define end points of the bone flexure shape recess 1368, wherein the centerline 1342 intersects the two end vertices 1356. In many embodiments, at least one vertex 1352 can be located closest to the centerline 1342. In other embodiments, two vertices 1352 can be located closest to the centerline 1342. Each bone flexure shape recess 1368 can further comprise four inflection vertices 1360, 1362 located at the transitions between the concave and convex edges.

As illustrated in FIGS. 19 and 20, the bone flexure shape recess 1368 can comprise a substantially bone, barbell, drum stick, or extended water droplet shape. Each bone flexure shape recess 1368 can comprise a major end nodule 1370, a minor end nodule 1376, and an isthmus 1382. The isthmus 1382 connects the major end nodule 1370 to the minor end nodule 1376. The major end nodule 1370 can comprise a convex edge. The minor end nodule 1376 can comprise a convex edge. The isthmus 1382 can comprise at least one concave edge, wherein at least one concave edge of the isthmus 1382 connects with the convex edge of the major end nodule 1370 and the convex edge of the minor end module 1370. The isthmus 1382 can comprise two concave edges, wherein the concave edges of the isthmus 1382 connect with the convex edge of the major end nodule 1370 and the convex edge of the minor end module 1370. The major end nodule 1370 can be larger than the minor end nodule 1376. The major end nodule 1370 can comprise a major diameter and the minor end nodule 1376 can comprise a minor diameter, wherein the major diameter can be larger than the minor diameter. The major and minor end nodules can also be called depressions, depressed pools, epiphyses, knobs, or knots. The isthmus 1382 can also be called a strait, canal, shaft, channel, bridge, or narrowed portion.

Referring to FIG. 20, the bone flexure shape recess 1368 can be symmetric about the centerline 1342. The edges of the bone flexure shape recess 1368 on opposing sides of the centerline 1342 can be mirror images of each other. Further, a vertical axis (not shown) can intersect the nadir vertices 1352. The bone flexure shape recess 1368 may not be symmetric about the vertical axis intersecting the nadair vertices 1352.

The bone flexure shape recess 1368 can further be described as having two circular shapes being connected by the isthmus, bridge, or narrowed portion 1382. The circular shapes of the bone flexure shape recess 1368 can be described with respect to major and minor reference circles. The major reference circle 1372 can larger than the minor reference circle 1378. The bone flexure shape recess 1368 can be described as having the major reference circle 1372 and the minor reference circle 1378 connected by a narrowed portion 1382. The major reference circle 1372 can have a radius inclusively between about 0.025 inch and about 0.06 inch. The minor reference circle 1378 can have a radius inclusively between about 0.02 inch and 0.05 inch. In one example, the radius of the major reference circle 1372 can be 0.04 inch, and the radius of the minor reference circle 1378 can be 0.03 inch. Further, the concave edges of the narrowed portion 1382 can comprise a radius ranging from 0.10 inch to 0.25 inch. In one example, the convex edge radius of the narrowed portion 1382 can be 0.15 inch.

The major reference circle 1372 can at least partially define a boundary of the major end nodule 1370. For example, the major reference circle 1372 can coincide with a convex edge of the bone flexure shape recess 1368. In other words, the major reference circle 1372 can coincide with an edge of the bone flexure shape recess 1368, between two major end inflection vertices 1360, located on the major end nodule 1370. The major end nodule 1370 can comprise the major end vertex 1356, where the major reference circle 1372 coincides with the major end vertex 1356. A major nodule angle 1374 can be defined between the two major end inflection vertices 1360, around the major end nodule 1370. The major nodule angle 1374 can range, inclusively, between 135 degrees and 180 degrees, between 180 degrees and 225 degrees, or between 225 degrees and 270 degrees.

The minor reference circle 1378 can at least partially define a boundary of the minor end nodule 1376. For example, the minor reference circle 1378 can coincide with a convex edge of the bone flexure shape recess 1368. In other words, the minor reference circle 1378 can coincide with an edge of the bone flexure shape recess 1368, between two minor end inflection vertices 1362, located on the minor end nodule 1376. The minor end nodule 1376 can comprise the minor end vertex 1356, where the minor reference circle 1378 coincides with the minor end vertex 1356. A minor nodule angle 1380 can be measured between the two minor end inflection vertices 1362, around the minor end nodule 1376. The minor nodule angle 1380 can range, inclusively, between 135 degrees and 180 degrees, between 180 degrees and 225 degrees, or between 225 degrees and 270 degrees.

The isthmus 1382 can extend between the two major end inflection vertices 1360 and the two minor end inflection vertices 1362. The isthmus 1382 can comprise two concave edges. The two vertices 1352 can be located on the concave edges of the isthmus 1382, wherein the vertices 1352 can be located on the nadir or point located closest to the centerline 1342. The ends of the isthmus 1382 connect to the major and minor end nodules 1370, 1376. The transitions between the isthmus 1382 and the end nodules 1370, 1376 can be smooth such that no sharp edges form between the isthmus 1382 and the end nodules 1370, 1376. In other words, the perimeter edges of the bone flexure shape recess 1368 can smoothly or seamlessly transition between the end nodules 1370, 1376 and the isthmus 1382. The perimeter edges of the bone flexure shape recess 1368 are devoid of sharp edges or edges that converge to a point to minimize stress risers within the faceplate.

The minimum width of the bone flexure shape recess 1368 can be measured between opposing vertices 1352 on the concave edges of the bone flexure shape recess 1368. The minimum width of the bone flexure shape recess 1368 can be measured across the isthmus or narrowed portion 1382. The minimum width of the bone flexure shape recess 1368 can be inclusively between 0.02 inch and 0.03 inch, 0.03 inch and 0.04 inch, 0.04 inch and 0.05 inch, or 0.05 inch and 0.06 inch. In some embodiments, the minimum width of the bone flexure shape recess 1368 can be approximately 0.02 inch, 0.025 inch, 0.03 inch, 0.035 inch, 0.04 inch, 0.045 inch, or 0.05 inch.

A maximum length of the bone flexure shape recess 1368 can be measured between opposing vertices 1356 of the convex edges of the bone flexure shape recess 1368. The maximum length of the bone flexure shape recess 1368 can be measured between the vertices 1356 parallel to the centerline 1342. The maximum length can be inclusively between 0.25 inch and 0.50 inch. In some embodiments, the maximum length can be inclusively between 0.25 inch and 0.30 inch, 0.30 inch and 0.35 inch, 0.35 inch and 0.40 inch, 0.40 inch and 0.45 inch, or 0.45 inch and 0.50 inch. The isthmus 1382 can span between 40% and 80% of the bone flexure shape recess 1368 length.

Referring to FIGS. 19-21, in some embodiments, the lattice 1340 can comprise linear rows of bone flexure shape recesses 1368. Adjacent rows of bone flexure shape recesses 1368 can be oriented in different directions, wherein the major end nodules 1370 of a first row of bone flexure shape recesses 1368 point in a first direction, and the major end nodules 1370 of a second row of bone flexure shape recesses 1368 point in a second direction opposite the first direction. In other embodiments, adjacent rows of bone flexure shape recesses 1368 can be oriented in the same direction, wherein each row of bone flexure shape recesses 1368 can be oriented with the major end nodules 1370 pointing in the same direction. Further, adjacent rows of bone flexure shape recesses 1368 extending in the same direction can be staggered or offset from each other. When comparing adjacent rows of bone flexure shape recesses 1368 extending in the same direction, the major end nodules 1370 and the minor end nodules 1376 of adjacent bone flexure shape recesses 1368 can be offset or not aligned with each other.

Figure 24:
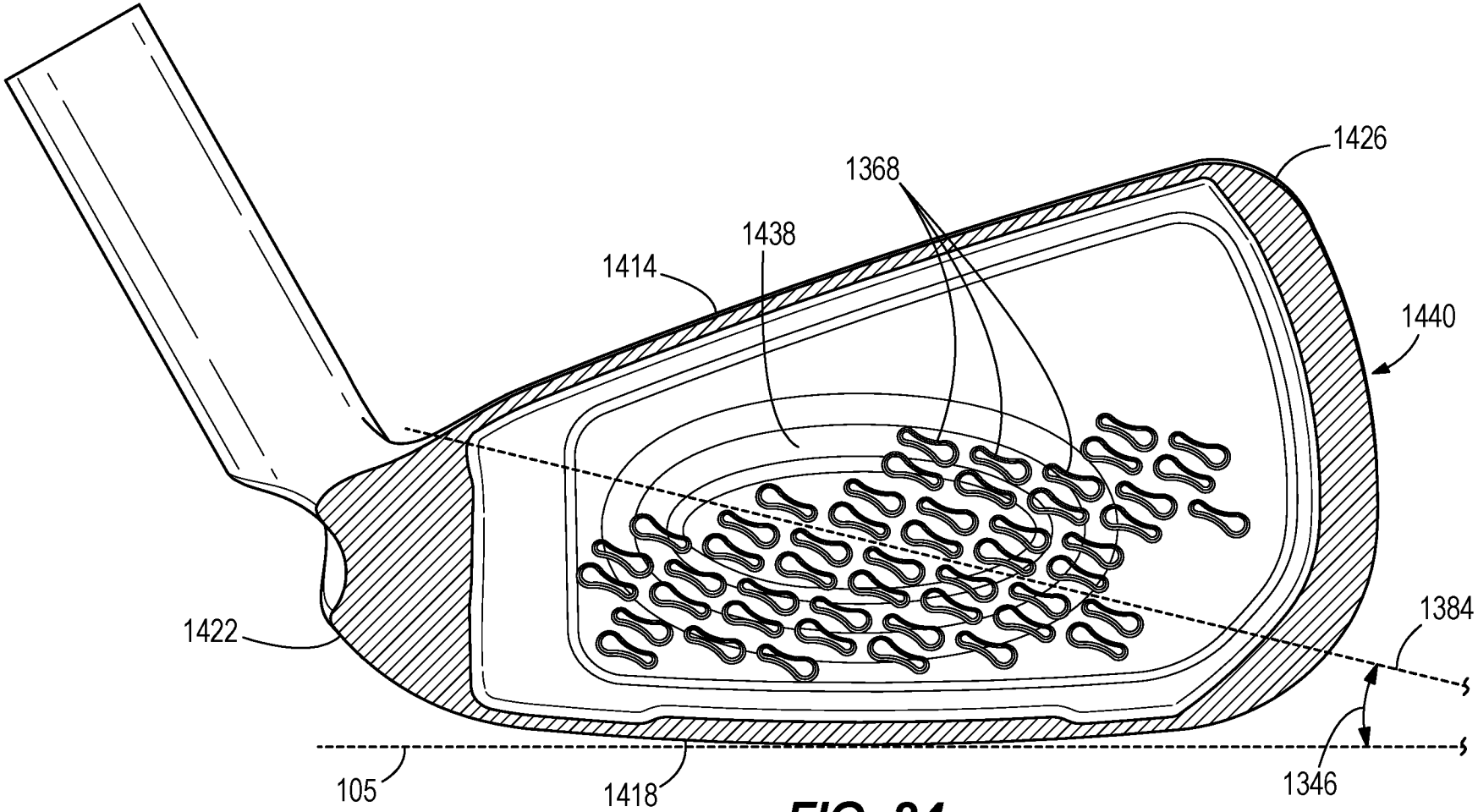
FIG. 24 illustrates a rear surface of the iron golf club head faceplate comprising a bone flexure shape recess faceplate lattice.

The lattice 1340 can be aligned in a low-toe to high-heel direction, a low-heel to high-toe direction, a heel to toe direction, a crown to sole direction, a horizontal direction, a vertical direction, or any combination thereof. For example, as illustrated in FIG. 21, the lattice 1340 can be aligned in a low-heel to high-toe direction, wherein a plurality of first bone flexure shape recess 1368 rows have the major end nodules 1370 point toward the high-toe, and a plurality of second bone flexure shape recess 1368 rows have the major end nodules 1370 point toward the low-heel. In another example, as illustrated in FIG. 24, the lattice 1340 can be aligned in a low-toe to high-heel direction, wherein a plurality of first bone flexure shape recess 1368 rows have the major end nodules 1370 point toward the low-toe, and a plurality of second bone flexure shape recess 1368 rows have the major end nodules 1370 point toward the high-heel.

The alignment direction of the lattice 1340 can impact the characteristic time of the faceplate within the center region 150, the peripheral region 154, the toe region 158, the heel region 162, the bottom region 166, the top region 170, the high-toe region 174, the low-toe region 178, the high-heel region 182, and/or the low-heel region 186. Furthermore, in some embodiments, the lattice 1340 is aligned to match the average shot dispersion across a faceplate. The lattice 1340 location can correspond to regions of the face that endure the most impacts. The ability of the lattice 1340 to distribute stress can result in greater durability, particularly within the area that experiences the greatest number of hits. Thus, the lattice 1340 alignment direction can be selected to increase the uniformity of the characteristic time response across the faceplate 130 and to increase durability.

The faceplate 130 comprising lattice 1340 can adjust characteristic time within USGA regulations. The faceplate 130 comprising the lattice 1340 reduces characteristic time while maintaining similar ball speed performance when compared to a similar faceplate devoid of the lattice 1340. In some examples, the faceplate 130 comprising the lattice 1340 decreases center CT by about 1 to 10 μs, or 1 to 5 μs when compared to a similar faceplate devoid of the lattice 1340. In other examples, the faceplate 130 comprising the lattice 1340 decreases center CT by about 1, 2, 3, 4, 5, 6, 7, 8, 9, or 10 μs when compared to a similar faceplate devoid of the lattice 1340. The faceplate 130 comprising the lattice 1340 maintains similar ball performance compared to the similar faceplate devoid of the lattice 1340. The faceplate 130 comprising the lattice 1340 provides desirable, lower characteristic time values while not sacrificing high ball speed performance.

As illustrated in FIG. 21, the lattice 1340 can be aligned along a reference direction 1384. Each row of flexure shape recesses 1368 can comprise the centerline 1342 extending through the end vertices 1356, wherein each flexure shape recess 1368 is aligned along the centerline 1342. The centerline 1342 of each row of flexure shape recesses 1368 can be parallel with the reference direction 1384. The lattice 1340 can be aligned such that the reference direction 1384 is offset from a ground plane 105 by an angle 1346 between 0 degrees and 179 degrees. In some embodiments, the angle 1346 can be inclusively between 0 degrees and 30 degrees, 30 degrees and 60 degrees, 60 degrees and 90 degrees, 90 degrees and 120 degrees, 120 degrees and 150 degrees, or 150 degrees and 179 degrees. In embodiments where the lattice 1340 is oriented in a low-heel to high-toe direction, the angle 1346 can be less than 90 degrees, less than 80 degrees, less than 70 degrees, less than 60 degrees, less than 50 degrees, less than 40 degrees, less than 30 degrees, or less than 20 degrees. In embodiments where the lattice 1340 is oriented in a low-heel to high-toe direction, the angle 1346 can range between 5 degrees and 60 degrees, 10 degrees to 70 degrees, 15 degrees to 80 degrees, or 20 degrees to 85 degrees. For example, in embodiments where the lattice 1340 can be oriented in a low-heel to high-toe direction, the angle 1346 can be approximately 5 degrees, 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees, 80 degrees, or 85 degrees.

Furthermore, similar to lattice 140, the lattice 1340 can be positioned on the center region 150, the high-toe region 174, the low-toe region 178, the high-heel region 182, the low-heel region 178, or any combination thereof. The lattice 1340 can be formed as a circular region, an elliptical region, or a combination thereof, centered around the geometric center of the faceplate. As illustrated in FIG. 21, the lattice 1340 can be formed as a elliptical region aligned in the low-heel to high-toe direction. Further, the lattice 1340 can be formed as a combination of a circular region and a elliptical region aligned in the low-heel to high-toe direction.

The plurality of flexure shape recesses of the lattice 540, 640, 740, 840, 940, and 1340 (hereafter "the lattice") formed from the plurality of land portions affects the faceplate bending during golf ball impacts. During golf ball impacts, the flexure shape recesses of the lattice resemble springs storing energy through tension and torsion loads. As the golf ball impacts the faceplate, the strike face is in compression and the back face is in tension. As tension is applied to the back face, the flexure shape recesses expand at the reflex angle vertices (i.e. the flexure shape recesses increase in size or volume). This expansion allows the flexure shape recesses to store energy in the faceplate through linear and torsional bending (i.e. similar to a spring storing energy through tension and torsion). Storing energy through two modes of bending is advantageous over conventional club head faceplates that store energy through one mode of bending (i.e. linear bending). Storing energy though two modes of bending allows for greater ball speeds during golf ball impacts.

Further, the flexure shapes of the lattice reduce the largest stresses concentrated in a small volume of the faceplate material (i.e. impact area of the faceplate) by displacing the reduced stress over a greater volume of the faceplate material. For example, the reduced stress can be displaced over 3 to 8 flexure shape recesses in a direction from near the faceplate center 132 to near the faceplate perimeter 136 in the lattice 540, 640, 740, 840, 940, or 1340. In some embodiments, the reduced stress can be displaced over 3 to 5, 4 to 6, 5 to 7, or 6 to 8 flexure shape recesses in a direction from near the faceplate center 132 to near the faceplate perimeter 136. This reduction in stress does not occur in a faceplate devoid of lattice 540, 640, 740, 840, 940, or 1340.

Additionally, inclusion of the lattice on the rear surface of the faceplate can result in a more uniform characteristic time response across the face. Faceplates including the lattice 540, 640, 740, 840, 940, 1040, 1140, 1240, or 1340 can maintain the characteristic time within the USGA regulations. In some embodiments, the faceplates including the lattice 540, 640, 740, 840, 940, 1040, 1140, 1240, or 1340 can reduce the center characteristic time while maintaining similar ball speed performance when compared to a similar faceplate devoid of the lattices 540, 640, 740, 840, 940, 1040, 1140, 1240, or 1340. Reducing center characteristic time is desirable to conform with the USGA's regulations.

Flexure Shape Recesses Defined by Land Portions with Geometric Shapes

As discussed above, the lattice can comprise a plurality of flexure shapes that are formed from a plurality of land portions. The plurality of land portions can form a plurality of flexure shape recesses, where the plurality of land portions separate the plurality of flexure shape recesses. The land portions are interconnected with one another and define the portions of the club head 100 that are devoid of the flexure shape recesses. The land portions form a perimeter of the flexure shape recesses. In some embodiments, the perimeter of the flexure shape recess can comprise a reentrant, concave, or non-convex shape. In other embodiments, the perimeter of the flexure shape recess can be devoid of a reentrant, concave, non-convex shape.

The land portions can comprise a geometric shape between adjacent flexure shape recesses. The geometric shape of the land portions can comprise a triangle, a square, a rectangle, a rhombus, a parallelogram, a quadrilateral, a polygon, or a hexagon. The geometric shape of the land portions can be interconnected with one another, where the land portions form a series of interconnected geometric shapes between the flexure shape recesses.

The geometric shape of the land portion can form a portion of one or more flexure shape recesses. For example, a land portion can comprise a triangular shape that forms a portion of three flexure shape recesses. In another example, a land portion can comprise a quadrilateral shape that forms a portion of four flexure shape recesses.

The land portions can comprise a width between adjacent flexure shape recesses. The land portion width can be measured from a flexure shape recess perimeter to an adjacent flexure shape recess perimeter. The land portion width can vary or remain constant between adjacent flexure shape recesses. Adjacent land portion widths can be similar or different from each other. For example, the land portion width can remain constant along one portion of the flexure shape recess perimeter, and the land portion width can vary along another portion of the flexure shape recess perimeter.

In some embodiments, the land portion width can be greater than 0.02 inch, greater than 0.05 inch, greater than 0.1 inch, greater than 0.15 inch, or greater than 0.2 inch. In some embodiments, the land portion width can range from 0.02 to 0.2 inch. In some embodiments, the land portion width can range from 0.02 to 0.1 inch, or 0.1 to 0.2 inch. In some embodiments, the land portion width can range from 0.02 to 0.05 inch, 0.05 to 0.08 inch, 0.08 to 0.11 inch, 0.11 to 0.14 inch, 0.14 to 0.17 inch, or 0.17 to 0.2 inch. For example, the land portion width can be 0.02, 0.03, 0.04, 0.05, 0.06, 0.08, 0.09, 0.1, 0.11, 0.12, 0.13, 0.14, 0.15, 0.16, 0.17, 0.18, 0.19, or 0.2 inch.

The flexure shape recess can comprise a width. The flexure shape recess width can be greater than 0.08 inch, greater than 0.1 inch, greater than 0.12 inch, greater than 0.14 inch, greater than 0.16 inch, greater than 0.18 inch, or greater than 0.2 inch. In some embodiments, the flexure shape recess width can range from 0.1 to 0.3 inch. In some embodiments, the flexure shape recess width can range from 0.1 to 0.2, or 0.2 to 0.3 inch. For example, the flexure shape recess width can be 0.1, 0.11, 0.12, 0.125, 0.13, 0.14, 0.15, 0.16, 0.17, 0.18, 0.19, 0.2, 0.25, or 0.3 inch.

The lattice comprising the flexure shape recesses formed from the plurality of land portions facilitates in storing greater energy in the faceplate to allow for greater ball speed during golf ball impacts. Described below are four examples of lattices comprising land portions with geometric shapes and flexure shape recesses. The flexure shape recess examples described below are in reference to one orientation, but it would be appreciated that the flexure shape recesses can be oriented in several different configurations to achieve greater faceplate energy storage and greater ball speed during golf ball impacts.

Land Portions with Triangle Shapes

In one example, as illustrated in FIG. 14 and as described above, the faceplate 130 can comprise the lattice 940. The lattice 940 can be similar to lattice 140 described above, but can differ in size, shape, or dimensions. The plurality of land portions 964 can form a plurality of three-pointed star flexure shape recesses 968. The three-pointed star flexure shape recesses 968 can comprise a reentrant, concave, or non-convex shape. The land portions 964 can comprise a triangular shape. In this example, six land portions 964 having the triangular shape can form one flexure shape recess 968. The land portions 964 can comprise a series of interconnected triangular shapes.

In another example, as illustrated in FIG. 15, the faceplate 130 can comprise a lattice 1040. The lattice 1040 can be similar to lattice 140 described above, but can differ in size, shape, or dimensions. The lattice 1040 can be similar to lattice 940 described above but differ in shape geometry. A plurality of land portions 1064 can form a plurality of triad flexure shape recesses 1068. The triad flexure shape recesses 1068 can comprise a reentrant, concave, or non-convex shape. The triad flexure shape recesses 1068 can comprise a substantially triangular shape with rounds (i.e. the perimeter of the triad flexure shape recess 1068 is more rounded than flexure shape recess 968).

The land portions 1064 can comprise a substantially triangular shape. In this example, six land portions 1064 having the substantially triangular shape can form one flexure shape recess 1068. The land portions 1064 can comprise a series of interconnected triangular shapes, similar to the lattice 940 described above. As described above, the width of the land portions 1064 can be greater than 0.02 inch, greater than 0.05 inch, greater than 0.1 inch, greater than 0.15 inch, or greater than 0.2 inch. In some embodiments, as described above, the width of the land portions 1064 can range from 0.02 to 0.2 inch.

As described above, the width of the triad flexure shape recess 1068 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the triad flexure shape recess 1068 can range from 0.1 to 0.3 inch. In one example, the width of the triad flexure shape recess 1068 can be 0.125 inch.

The triad flexure shape recess 1068 can comprise a radius. The radius of the triad flexure shape recess 1068 can range from 0.01 to 0.05 inch. In some embodiments, the radius of the triad flexure shape recess 1068 can range from 0.01 to 0.025 inch, or 0.025 to 0.05 inch. For example, the radius of the triad flexure shape recess 1068 can be 0.01, 0.011, 0.02, 0.03, 0.04, or 0.05 inch. In one example, the triad flexure shape recess 1068 can comprise three radii with a value of 0.011 inch.

Land Portions with Quadrilateral Shapes

In another example, as illustrated in FIG. 16, the faceplate 130 can comprise a lattice 1140. The lattice 1140 can be similar to lattice 140 described above, but differ in size, shape, or dimensions. A plurality of land portions 1164 can form a plurality of diamond flexure shape recesses 1168. The diamond flexure shape recesses 1168 can have a convex shape. More specifically, the diamond flexure shape recesses 1168 can comprise a diamond, a rectangle, a rhombus, a parallelogram, or any quadrilateral shape. The land portions 1164 can comprise a square shape. In other embodiments, the land portions 1164 can comprise a rectangle, a rhombus, a parallelogram, or any quadrilateral shape.

In this example, four land portions 1164 having the square shape can form one flexure shape recess 1168. The land portions 1164 can comprise a series of interconnected square shapes.

The width of the land portions 1164 can correspond with the width of the diamond flexure shape recesses 1168. The width of the land portions 1164 can remain constant between adjacent diamond flexure shape recesses 1168. As described above, the width of the land portions 1164 can be greater than 0.02 inch, greater than 0.05 inch, greater than 0.1 inch, greater than 0.15 inch, or greater than 0.2 inch. In some embodiments, as described above, the width of the land portions 1164 can range from 0.02 to 0.2 inch.

As described above, the width of the diamond flexure shape recess 1168 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the diamond flexure shape recess 1168 can range from 0.1 to 0.3 inch. In one example, the width of the diamond flexure shape recess 1168 can be 0.125 inch.

Land Portions with Hexagon Shapes

In another example, as illustrated in FIG. 17, the faceplate 130 can comprise a lattice 1240. The lattice 1240 can be similar to lattice 140 described above, but differ in size, shape, or dimensions. A plurality of land portions 1264 can form a plurality of slot flexure shape recesses 1268. The slot flexure shape recesses 1268 can comprise a shape that resembles a slot, or a rectangle with rounded ends. The slot flexure shape recesses 1268 can comprise a convex shape. The land portions 1264 can comprise a hexagon shape.

In this example, five slot flexure shape recesses 1268 can be arranged to form one land portion 1264 with the hexagon shape. The slot flexure shape recesses 1268 can be arranged to form a plurality of interconnected land portions 1264 that have a hexagon shape.

As described above, the width of the land portions 1264 can be greater than 0.02 inch, greater than 0.05 inch, greater than 0.1 inch, greater than 0.15 inch, or greater than 0.2 inch. In some embodiments, as described above, the width of the land portions 1264 can range from 0.02 to 0.2 inch.

As described above, the width of the slot flexure shape recess 1268 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the slot flexure shape recess 1268 can range from 0.1 to 0.3 inch. In one example, the width of the slot flexure shape recess 1268 can be 0.125 inch.

The plurality of flexure shape recesses of the lattice 940, 1040, 1140, or 1240 (hereafter "the lattice") formed from the plurality of land portions with geometric shapes affects the faceplate bending during golf ball impacts. During golf ball impacts, the land portions of the lattice resemble springs storing energy through tension and torsion loads. As the golf ball impacts the faceplate 130, the strike face 134 is in compression and the back face 138 is in tension. As tension is applied to the back face 138, the land portions deflect linearly and rotational. This linear and rotational movement allows the land portions to store energy in the faceplate 130 through linear and torsional bending (i.e. similar to a spring storing energy through tension and torsion). Storing energy through two modes of bending is advantageous over conventional club head faceplates that store energy through one mode of bending (i.e. linear bending). Storing energy though two modes of bending allows for greater ball speeds during golf ball impacts.

Further, the flexure shapes of the lattice reduce the largest stresses concentrated in a small volume of the faceplate material (i.e. impact area of the faceplate) by displacing the reduced stress over a greater volume of the faceplate material. For example, the reduced stress can be displaced over 3 to 8 land portions in a direction from near the faceplate center 132 to near the faceplate perimeter 136 in the lattice 1040, 1140, or 1240. In some embodiments, the reduced stress can be displaced over 3 to 5, 4 to 6, 5 to 7, or 6 to 8 land portions in a direction from near the faceplate center 132 to near the faceplate perimeter 136. This reduction in stress does not occur in a faceplate devoid of lattice 1040, 1140, or 1240.

Iron Golf Club Head

Figure 22:
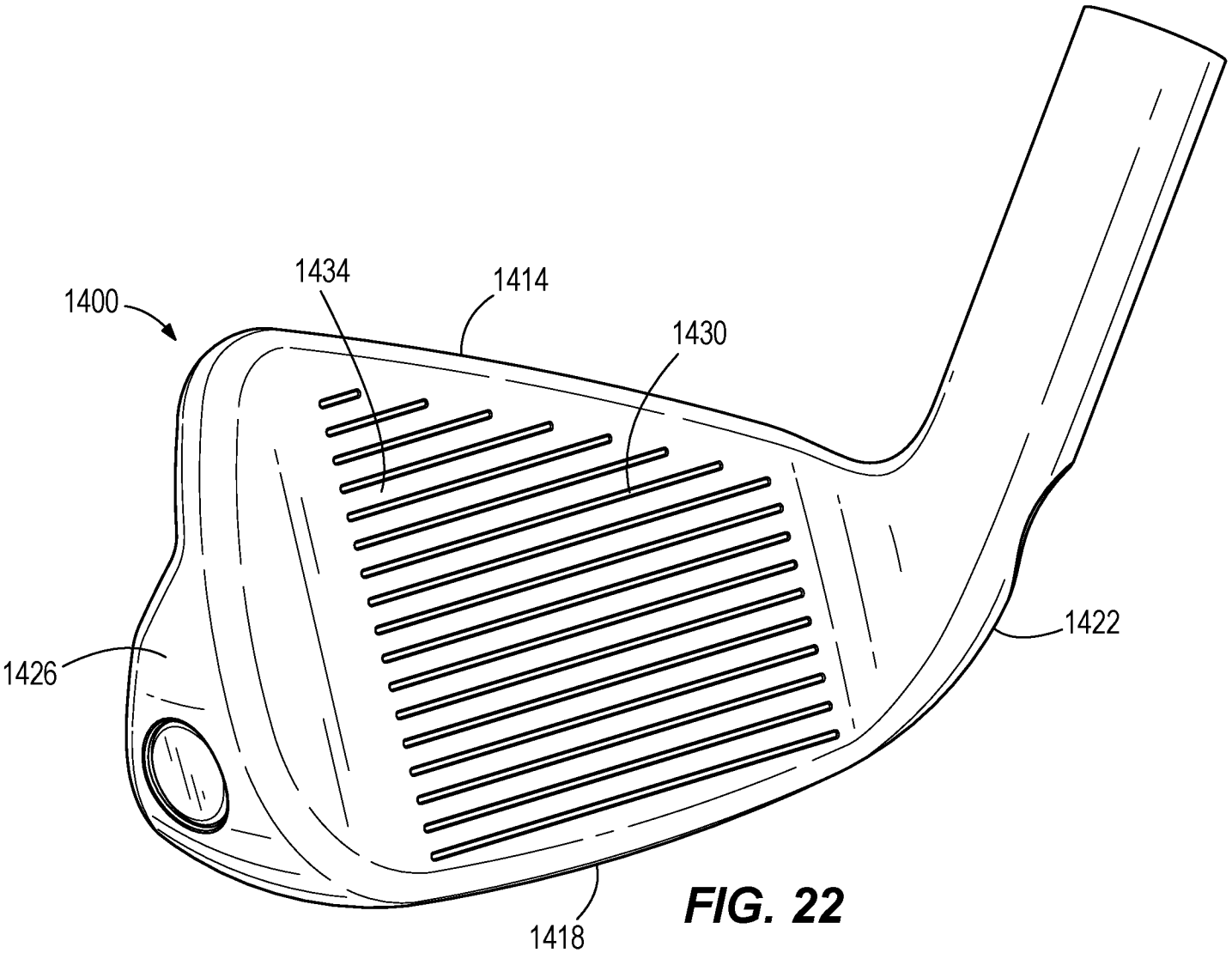
FIG. 22 illustrates a front perspective view of a iron golf club head.
Figure 23:
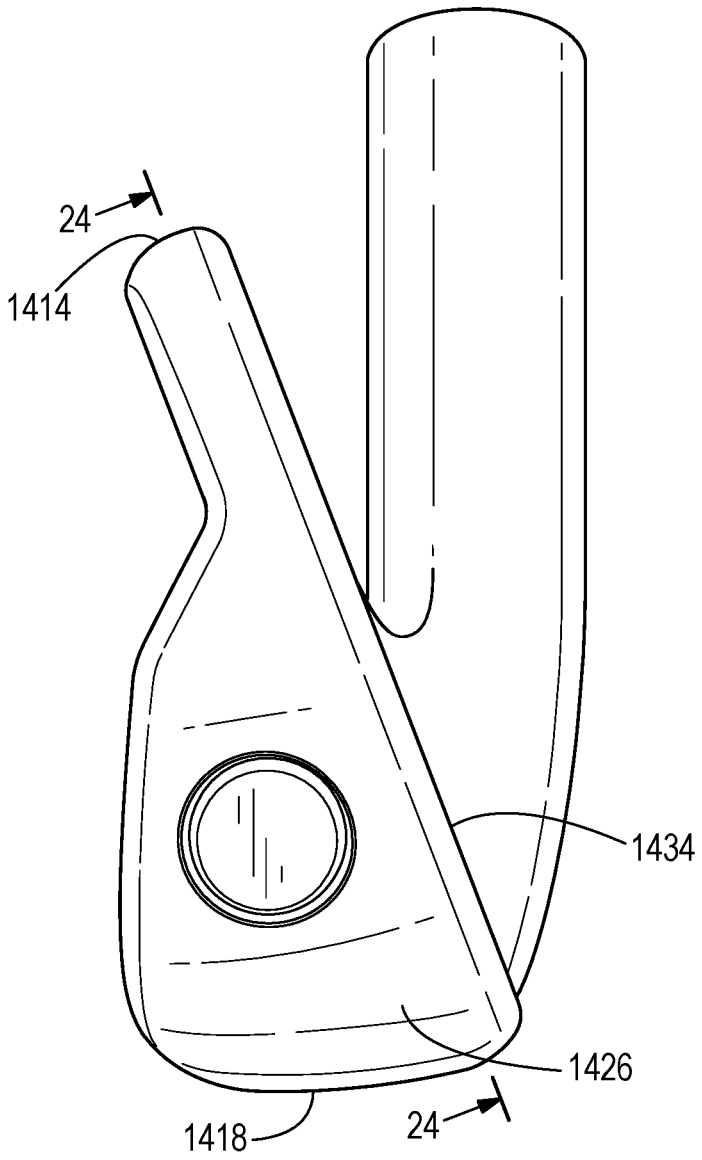
FIG. 23 illustrates a toe view of the iron golf club head of FIG. 22.

Referring to FIGS. 22-24, wherein like reference numerals are used to identify like or identical components in various views, FIG. 22 illustrates a front perspective view of a iron golf club head 1400. The iron club head 1400 includes a faceplate 1430 and a body 1410 that are secured together to define a substantially closed/hollow interior volume. The club head 1400 includes a top rail 1414, a sole 1418 opposite the top rail 1414, a heel 1422, and a toe 1826 opposite the heel 1422.

As illustrated in FIGS. 22-24, the faceplate 1430 includes a strike face 1434 intended to impact a golf ball, and a back face 1438 opposite the strike face 1434. The strike face 1434 can comprise a variable thickness profile as described above for the club head 100. The club head 1400 can comprise similar faceplate regions as described above for the club head 100. The club head 1400 can be similar to the club head 100 described above, but differ in volume, size, and faceplate dimensions. The club head 1400 is a smaller club head when compared to the wood type club head 100, and can comprise smaller or lower numerical values for volume, club head dimensions, and faceplate dimensions.

The faceplate 1430 of the club head 1400 further includes a lattice 1440 having a plurality of flexure shapes recessed into the faceplate 1430. The lattice 1440 can be recessed into the back face 1438 of the faceplate 1430. The lattice 1440 can be located within the closed/hollow interior volume of the club head 1400, where the lattice 1440 is not exposed or visible to an exterior surface of the club head 1400. The lattice 1440 can comprise the faceplate lattices as described in this disclosure. It would be appreciated the lattice 1440 of the club head 1400 can be modified in terms of size, shape, and/or number to accommodate the smaller faceplate 1430 dimensions of the club head 1400.

In one example, as illustrated in FIG. 24, the faceplate 1430 can comprise the lattice 1340 having the plurality of bone flexure shape recesses 1368 as described above. As illustrated in FIG. 24, the bone flexure shape recesses 1368 can be aligned in rows, wherein each row of bone flexure shape recesses 1368 is aligned in a low-toe to high-heel direction. A plurality of bone flexure shape recesses 1368 rows can have the major end nodules 1370 point toward the low-toe, and a plurality of bone flexure shape recess 1368 rows can have the major end nodules 1370 point toward the high-heel. Further, the bone flexure shape recesses 1368 can be aligned in rows, wherein each row of bone flexure shape recesses 1368 is aligned in a high-toe to low-heel direction. When comparing adjacent rows of bone flexure shape recesses 1368 extending in the low-toe to high-heel direction, the major end nodules 1370 of a first row can be aligned with the minor end nodules 1376 of a second row. The alignment direction of the bone flexure shape recess 1368 rows improves faceplate bending thereby improving ball performance for off center hits.

Method of Manufacturing Golf Club Head Faceplates with Lattices

A method of manufacturing a club head 100 having a faceplate 130 with a lattice described in this disclosure is provided. The method includes providing a body 110 and a faceplate 130, where the faceplate 130 is coupled with the body 110 to define a substantially hollow/closed structure. The body 110 can be created or formed by casting, forging, machining, additive manufacturing, 3D printing, or any suitable method or combination thereof. In some embodiments, the body 110 can be altered by electro-discharging machining (EDM) or chemical etching. Similarly, the faceplate 130 can be created or formed by casting, forging, machining, additive manufacturing, 3D printing, or any suitable method or combination thereof, and can be altered by electro-discharging machining (EDM) or chemical etching. In some embodiments, the faceplate 130 can be welded onto the body 110. In other embodiments, the faceplate 130 and the body 110 can be formed together as one integral piece.

In one embodiment, the faceplate 130 can be formed from additive manufacturing methods such as powdered metal sintering. The powdered metal sintering system involves a bed of metal powder that is sintered or melted layer by layer by a heated source such as a laser. The layer by layer technique forms a three-dimensional faceplate 130 with the lattice from the layered metal. The lattice 540, 640, 740, 840, 940, 1040, 1140, 1240, or 1340 can be integrally formed into the faceplate 130 during the powdered metal sintering process.

In another embodiment, the faceplate 130 can be formed through a forging process. In some iterations of the method, the lattice 540, 640, 740, 840, 940, 1040, 1140, 1240, or 1340 can be integrally formed into the faceplate 130 during the initial forging process. In other iterations of the method, the lattice 540, 640, 740, 840, 940, 1040, 1140, 1240, or 1340 can be formed into the faceplate 130 during a secondary forging step. In some embodiments, the faceplate 130 is further heat treated after the forging process is completed.

The advantages of using these methods to form the faceplate 130 lattice is to minimize large stress concentrations in the faceplate 130 during golf ball impacts. In particular, these methods provide small fillets (e.g. 0.015 to 0.05 inch) on the edges of the lattice rather than squared or sharp edges. Methods such as milling or end milling are not advantageous in forming the lattice because these methods form square or sharp edges, which creates a high degree of stress concentration within the lattice and leads to failures of the faceplate 130 during golf ball impacts.

EXAMPLES

Example 1—Coefficient of Restitution (COR) Faceplate Test

An exemplary faceplate 130 comprising a lattice and a variable face thickness was compared to a similar control faceplate, but devoid of a lattice. The exemplary faceplate 130 comprises a variable faceplate thickness including a faceplate perimeter thickness of 0.09 inch, a faceplate center thickness of 0.20 inch, a lattice depth of 0.05 inch, and the lattice 1040 with the triad flexure shape recesses 1068. The control faceplate comprises a variable faceplate thickness including a faceplate perimeter thickness of 0.09 inch, a faceplate center thickness of 0.20 inch. The exemplary faceplate 130 and the control faceplate comprise a titanium alloy (i.e. Ti-6-4).

A test was conducted to compare the coefficient of restitution (COR) between the exemplary faceplate 130 and the control faceplate. The coefficient of restitution (COR) is the ratio of the final to initial velocity between the collision of the golf ball and the faceplate. The test used an air cannon that fired golf balls at each faceplate. The distance the air cannon was positioned from each faceplate was held constant, and each faceplate was held in a fixed position. The test resulted in the exemplary faceplate 130 averaging a COR value of 0.827 and the control faceplate averaging a COR value of 0.795. The results show that the exemplary faceplate 130 had on average a 3.54% increase in COR over the control faceplate. The lattice of the exemplary faceplate 130 allows for energy storage through two modes of bending (i.e. linear and torsional) thereby increasing the COR to provide greater ball speeds during golf ball impacts.

Example 2—Internal Energy Faceplate Test

An exemplary faceplate 130 comprising a lattice 240 with sunburst grooves and a variable face thickness was compared to a similar control faceplate, but devoid of a lattice and a variable face thickness. The exemplary faceplate 130 comprises a variable faceplate thickness including a faceplate perimeter thickness of 0.09 inch, a faceplate center thickness of 0.20 inch, a lattice depth of 0.05 inch. The control faceplate comprises a constant faceplate thickness of 0.115 inch (USGA standard faceplate).

A test was conducted to compare the internal energy between the exemplary faceplate 130 and the control faceplate. The test used finite element simulations that modeled an impact of a golf ball on the striking surface with a ball speed ranging from 90 to 115 mph. The internal energy is measured in lbf-inch. The test resulted in the exemplary faceplate 130 having an internal energy of 80 to 82 lbf-inch and the control faceplate having an internal energy of 71 lbf-inch. The results show that the exemplary faceplate 130 having the lattice 240 with sunburst grooves had a 10% to 15% increase in internal energy. This internal energy increase equates to a ball speed increase of approximately 1 to 3 mph. The lattice 240 of the exemplary faceplate 130 allows for greater energy storage by storing energy through two modes of bending (i.e. linear and torsional), which allows for greater ball speeds during golf ball impacts.

Example 3—Coefficient of Restitution (COR) Faceplate Test

A comparison was done between a first exemplary faceplate 130 comprising a first lattice, a second exemplary faceplate 130 comprising a second lattice, and a control faceplate. The control faceplate lacked a lattice but was otherwise similar to the first and second exemplary faceplates. All three faceplates comprised a similar variable face thickness and were formed from the same metal material. The lattices of the first and second exemplary faceplates 130 were formed by electro-discharging machining (EDM).

The first exemplary faceplate 130 comprised a lattice 240 with sunburst grooves. The second exemplary faceplate 130 comprised a lattice 1040 with triad flexure shape recesses 1068. The control faceplate was devoid of a lattice. The lattices 240, 1040 measured a uniform depth of approximately 0.05 inch and had groove widths of approximately 0.04 inch.

A test was conducted to compare the coefficient of restitution (COR) between the exemplary faceplates 130 and the control faceplate. The test used an air cannon that fired golf balls at each faceplate. The distance the air cannon was positioned from each faceplate was held constant, and each faceplate was held in a fixed position. The test resulted in the first exemplary faceplate 130, having the lattice 240 with the sunburst grooves, averaging a COR value of 0.761. The second exemplary faceplate 130, with the triad flexure shape recesses 1068, averaged a COR value of 0.765. The control faceplate averaged a COR value of 0.758. The results show that the first exemplary faceplate 130 had on average a 0.4% increase in COR over the control faceplate, and the second exemplary faceplate 130 had on average a 0.9% increase in COR over the control faceplate.

The lattice of the first and second exemplary faceplates 130 allows for energy storage through two modes of bending (i.e. linear and torsional) thereby increasing the COR to provide greater ball speeds during golf ball impacts.

Example 4—Stat Area Tests

An exemplary faceplate 130 comprising a lattice 1340 with bone flexure shape recesses 1368 was compared to a similar control faceplate devoid of a lattice feature. The exemplary faceplate 130 comprised a forged faceplate, the bone shaped recesses 1368, and a lattice depth of 0.01 inch. The control faceplate 130 comprised similar faceplate dimensions (i.e. thickness, height, and width, material) as the exemplary faceplate 130, but was devoid of the lattice feature.

A test was conduced to compare the stat area (i.e. standard deviation of a collection of golf ball carry distances multiplied by the standard deviation of a collection of golf ball offline distances) between the exemplary faceplate 130 and the control faceplate. The golf ball carry distance is a distance the golf ball travels in the air. The golf ball offline distance is a distance the golf ball is offset from a line extending from the player to the desired target. The golf ball offline distance is measured perpendicular to the line extending from the player to the desired target. The stat area determines the precision of the grouping or dispersion for a collection of golf ball shots, where a tighter dispersion indicates a lower stat area, and a larger dispersion indicates a higher stat area. The test resulted in the exemplary faceplate 130 averaging about a 33% decrease in stat area compared to the control faceplate (i.e. less ball dispersion). The exemplary faceplate 130 comprising the lattice 1340 with bone shaped recesses 1368 reduces the difference in ball carry distance between center and off-center hits, or provides similar ball carry distance for center and off-center hits. The exemplary faceplate 130 comprising the lattice 1340 with bone shaped recesses 1368 provides a desirable lower stat area to allow for a greater precision in golf ball shot dispersion over a club head devoid of the lattice feature.

Example 5—Golf Ball Offline Distance Tests

An exemplary faceplate 130 comprising a lattice 1340 with bone flexure shape recesses 1368 was compared to a similar control faceplate devoid of a lattice feature. The exemplary faceplate 130 comprised a forged faceplate, the bone shaped recesses 1368, and a lattice depth of 0.01 inch. The control faceplate 130 comprised similar faceplate dimensions (i.e. thickness, height, and width, material) as the exemplary faceplate 130, but was devoid of the lattice feature.

A test was conducted to compare the amount of offline distance the golf ball traveled for various hits across the faceplate. The various hits were measured at the center of the faceplate, and within a one inch offset from the faceplate center in a direction extending towards the heel, the toe, the crown, and the sole on the faceplate. The golf ball offline distance is a distance the golf ball is offset from a line extending from the player to the desired target. The line extending from the player to the desired target is the golf flight path the player wants to achieve. The golf ball offline distance is measured perpendicular to the line extending from the player to the desired target. The test resulted in the exemplary faceplate 130 averaging less than 10 yards of offline distance for hits within 0.5 inch from the faceplate center, and the control faceplate averaging 10 yards or more in a direction left of the player for hits within 0.5 inch from the faceplate center. In some examples, the exemplary faceplate 130 average approximately 8 yards of offline distance, and the control faceplate averaging 11 yards of offline distance. In these examples, the exemplary faceplate 130 provides a 4 yard decrease in offline distance, or approximately a 30% decrease in offline distance.

The exemplary faceplate 130 comprising the lattice 1340 with the bone shaped recesses 1368 provided consistent ball flight for impacts at the center, and within 0.5 inch from the center in all directions. The exemplary faceplate 130 comprising the lattice 1340 with the bone shaped recesses 1368 provides similar straight ball flight for center hits, low heel hits, and high toe hits (i.e. low heel and high toe hits see the largest bend in shot shape). The control faceplate 130 requires hitting lower on the faceplate to achieve a straighter golf ball path, which requires more precision and is harder to achieve. The exemplary faceplate 130 achieves improved ball flight for hits higher on the faceplate 130, which requires less precision and is easier to achieve.

Example 6—Characteristic Time Test

An exemplary faceplate 130 comprising a lattice 1340 with bone flexure shape recesses 1368 was compared to a similar control faceplate devoid of a lattice feature. The exemplary faceplate 130 comprised a forged faceplate and the bone flexure shape recesses 1368 arranged in a low-heel to high-toe direction. The control faceplate 130 comprised similar faceplate dimensions (i.e. thickness, height, and width, material) as the exemplary faceplate 130, but was devoid of the lattice feature.

A test was conducted to measured the characteristic time and the ball speed between the exemplary faceplate 130 and the control faceplate. The characteristic time was measured using the standard USGA test described in this disclosure. The ball speed measurements were collected from a collection of golf player's shots. The test resulted in the exemplary faceplate 130 having a characteristic time at a faceplate center of 228 μs, and a average ball speed of approximately 160.1 mph. The test resulted in the control faceplate having a characteristic time at a faceplate center of 237 μs, and an average ball speed of approximately 160.7 mph. The test resulted in the exemplary faceplate 130 having the center characteristic time 9 μs less than the center characteristic time of the control faceplate. In other embodiments, the center characteristic time of the exemplary faceplate 130 can be 1 to 10 μs, or 1 to 5 μs less than the center characteristic time of the control faceplate. Further, the test resulted in the exemplary faceplate 130 having a similar ball speed as the control faceplate. The exemplary faceplate 130 comprising the lattice 1340 with bone flexure shape recesses 1368 provided a desirable, lower center characteristic time value while not sacrificing high ball speed performance.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1. A golf club head comprising: a faceplate comprising a lattice, the lattice comprises a plurality of grooves arranged in a sunburst pattern, each sunburst groove comprises: a base groove; and a plurality of ligament grooves, the plurality of ligament grooves connected to the base groove and extending outward from the base groove; wherein the base groove comprises a circular shape; wherein the ligament groove comprises at least one curve; and wherein at least three sunburst grooves form a flexure shape, the flexure shape comprises a portion of at least three base grooves and at least three ligament grooves to form a series of convex and concave curves relative to a center of the flexure shape; and wherein the series of convex and concave curves of the flexure shape flex during golf ball impacts to store energy through linear and torsional bending.

Clause 2. The golf club head of clause 1, wherein the plurality of sunburst grooves comprises a repeating pattern of flexure shapes interspersed in a repeating pattern of circular shapes.

Clause 3. The golf club head of clause 1, wherein the flexure shape comprises a reentrant shape.

Clause 4. The golf club head of clause 2, wherein the plurality of flexure shapes are positioned on a faceplate region selected from the group consisting of a center region, a toe region, a heel region, a top region, a bottom region, a high-toe region, a low-toe region, a high-heel region, and a low-heel region.

Clause 5. The golf club head of clause 1, wherein the plurality of ligament grooves are equally spaced along the base groove.

Clause 6. The golf club head of clause 1, wherein the base groove comprises a width ranging from 0.01 inch to 0.05 inch.

Clause 7. The golf club head of clause 1, wherein the ligament groove comprises a width ranging from 0.01 inch to 0.05 inch.

Clause 8. The golf club head of clause 1, wherein a depth of the plurality of grooves ranges from 0.025 inch to 0.075 inch.

Clause 9. A golf club head comprising: a faceplate comprising a lattice, the lattice comprises a plurality of grooves arranged in a sunburst pattern, each sunburst groove comprises: a base groove; and a plurality of ligament grooves, the plurality of ligament grooves connected to the base groove and extending outward from the base groove; wherein the base groove comprises a circular shape; wherein the ligament grooves comprise at least one curve; wherein at least three sunburst grooves form a flexure shape, the flexure shape comprises a portion of at least three base grooves and at least three ligament grooves to form a series of convex and concave curves relative to a center of the flexure shape; wherein the plurality of sunburst grooves comprises a repeating pattern of interconnected flexure shapes; and wherein the series of convex and concave curves of the flexure shape flex during golf ball impacts to store energy through linear and torsional bending.

Clause 10. The golf club head of clause 9, wherein the plurality of flexure shapes are positioned on a faceplate region selected from the group consisting of a center region, a toe region, a heel region, a top region, a bottom region, a high-toe region, a low-toe region, a high-heel region, and a low-heel region.

Clause 11. The golf club head of clause 9, wherein the flexure shapes comprise a reentrant shape.

Clause 12. The golf club head of clause 9, wherein adjacent flexure shapes share at least one ligament groove.

Clause 13. The golf club head of clause 9, wherein the ligament grooves comprise a width ranging from 0.01 inch to 0.05 inch.

Clause 14. The golf club head of clause 9, wherein a depth of the plurality of grooves ranges from 0.025 inch to 0.075 inch.

Clause 15. A golf club head comprising: a faceplate comprising a lattice, the lattice comprises a plurality of grooves arranged in a sunburst pattern, each sunburst groove comprises: a base groove; and a plurality of ligament grooves, the plurality of ligament grooves connected to the base groove and extending outward from the base groove; wherein the base groove comprises a circular shape; wherein the ligament groove comprises a first curve, a second curve, and an inflection point positioned between the first curve and the second curve; wherein at least three sunburst grooves form a flexure shape, the flexure shape comprises a portion of at least three base grooves and at least three ligament grooves to form a series of convex and concave curves relative to a center of the flexure shape; wherein the flexure shape comprises a reentrant shape; and wherein the series of convex and concave curves of the flexure shape flex during golf ball impacts to store energy through linear and torsional bending.

Clause 16. The golf club head of clause 15, wherein the plurality of sunburst grooves comprises a repeating pattern of flexure shapes interspersed in a repeating pattern of circular shapes.

Clause 17. The golf club head of clause 15, wherein the plurality of flexure shape recesses are positioned on a faceplate region selected from the group consisting of a center region, a toe region, a heel region, a top region, a bottom region, a high-toe region, a low-toe region, a high-heel region, and a low-heel region.

Clause 18. The golf club head of clause 15, wherein the ligament groove comprises a width ranging from 0.01 inch to 0.05 inch.

Clause 19. The golf club head of clause 18, wherein the first curve and the second curve of the ligament groove comprise a similar width.

Clause 20. The golf club head of clause 15, wherein a depth of the plurality of grooves ranges from 0.025 inch to 0.075 inch.

Clause 21. The golf club head of clause 1, wherein the plurality of flexure shapes increase in size toward a faceplate region selected from the group consisting of a center region, a toe region, a heel region, a top region, a bottom region, a high-toe region, a low-toe region, a high-heel region, and a low-heel region.

Clause 22. The golf club head of clause 1, wherein the number of flexure shapes increase toward a faceplate region selected from the group consisting of a center region, a toe region, a heel region, a top region, a bottom region, a high-toe region, a low-toe region, a high-heel region, and a low-heel region.

Clause 23. A golf club head comprising: a faceplate comprising a lattice, the lattice comprises a plurality of land portions that form a plurality of flexure shape recesses, the plurality of flexure shape recesses comprises: at least two vertices that define acute interior angles; and at least one vertex defining a reflex angle; wherein: the land portions are interconnected with one another and define portions of the club head that are devoid of the flexure shape recesses; and the land portions separate the flexure shape recesses.

Clause 24. The golf club head of clause 23, wherein the reflex angle defines at least one concave portion on the flexure shape recess.

Clause 25. The golf club head of clause 23, wherein the flexure shape recess comprises two vertices that define a reflex angle, wherein the two reflex angles defines two concave portions on the flexure shape recess.

Clause 26. The golf club head of clause 23, wherein the acute interior angle defines an angle less than 90 degrees, and the reflex angle defines an angle greater than 180 degrees and less than 360 degrees.

Clause 26. A golf club head comprising: a faceplate comprising a lattice, the lattice comprises a plurality of land portions that form a plurality of flexure shape recesses, the plurality of land portions comprises: a geometric shape; wherein: the land portions are interconnected with one another, where the land portions separate the flexure shape recesses; and the land portions comprise a series of interconnected geometric shapes between the flexure shape recesses.

Clause 27. The golf club head of clause 26, wherein the geometric shape of the land portions is selected form the group consisting of a triangle, a square, a rectangle, a rhombus, a parallelogram, a quadrilateral, a polygon, and a hexagon.

Clause 28. A golf club head comprising: a faceplate comprising a lattice, a heel end, a toe end, and a reference direction; wherein the lattice comprises a plurality of recesses arranged in a repeating pattern; and each recess of the plurality of recesses comprises a bone shape, the bone shape comprising a plurality of concave and convex edges relative to a center.

Clause 29. The golf club head of clause 28, wherein: each recess of the plurality of recesses comprises two vertices that define apexes of two convex edges; and each recess of the plurality of recesses comprises a centerline that extends between the two vertices; and the reference direction extends in a high heel end to low toe end direction; each recess of the plurality of recesses is aligned such that its centerline is parallel with the reference direction.

Clause 30. The golf club head of clause 29, wherein each recess of the plurality of recesses is separate and not connected to adjacent recesses.

Clause 31. The golf club head of clause 29, wherein the plurality of recesses are oriented in rows; and wherein adjacent rows of the plurality of recesses are staggered relative to each other.

Clause 32. A golf club head comprising: a faceplate comprising a lattice; wherein the lattice comprises a plurality of recesses arranged in a repeating pattern; wherein each recess of the plurality of recesses comprises a bone shape, the bone shape comprising a major end nodule, a minor end nodule, and an isthmus connecting the major end nodule to the minor end nodule; wherein the major end nodule is larger than the minor end nodule; wherein each recess of the plurality of recesses is separate and not connected to adjacent recesses.

Clause 33. A golf club head comprising: a crown; a sole; a toe; a heel; a faceplate comprising a lattice, the lattice comprises a plurality of land portions that form a plurality of flexure shape recesses; each flexure shape recess comprises: a major end nodule; a minor end nodule; and a narrowed portion connecting the major end nodule and the minor end nodule; wherein the major end nodule comprises a circular shape with a major diameter; wherein the minor end nodule comprises a circular shape with a minor diameter; wherein the major diameter is larger than the minor diameter; and wherein the plurality of flexure shape recesses are separate and not connected with each other.

Clause 34. The golf club head of clause 1, wherein the plurality of flexure shape recesses are oriented in a plurality of linear rows.

Clause 35. The golf club head of clause 2, wherein the plurality of linear rows are oriented in a direction selected from the group consisting of a low-toe to high-heel direction, a low-heel to high-toe direction, a heel to toe direction, and a crown to sole direction.

Clause 36. The golf club head of clause 1, wherein a perimeter of each flexure shape recess comprises a plurality of concave and convex edges relative to a center of the flexure shape recess.

Clause 37. The golf club head of clause 4, wherein the major end nodule comprises a convex edge, the minor end nodule comprises a convex edge, and the narrowed portion comprises at least one concave edge.

Clause 38. The golf club head of clause 1, wherein the plurality of flexure shape recesses are positioned on a faceplate region selected from the group consisting of a center region, a toe region, a heel region, a top region, a bottom region, a high-toe region, a low-toe region, a high-heel region, and a low-heel region.

Clause 39. The golf club head of clause 1, wherein the faceplate comprising the plurality of land portions and the plurality of flexure shape recesses is formed a forging process.

Clause 40. A golf club head comprising: a crown; a sole; a toe; a heel; a faceplate comprising a lattice, the lattice comprises a plurality of land portions that form a plurality of flexure shape recesses; each flexure shape recess comprises: a major end nodule; a minor end nodule; and a narrowed portion connecting the major end nodule and the minor end nodule; wherein the major end nodule comprises a circular shape with a major diameter; wherein the minor end nodule comprises a circular shape with a minor diameter; wherein the major diameter is larger than the minor diameter; wherein a centerline extends through the flexure shape recess intersecting the major end nodule and the minor end nodule; wherein the narrowed portion of each flexure shape recess defines a concave portion of the flexure shape recess relative to the centerline; and wherein the plurality of flexure shape recesses are separate and not connected with each other.

Clause 41. The golf club head of clause 8, wherein the plurality of flexure shape recesses are oriented in a plurality of linear rows.

Clause 42. The golf club head of clause 9, wherein the plurality of linear rows are oriented in a direction selected from the group consisting of a low-toe to high-heel direction, a low-heel to high-toe direction, a heel to toe direction, and a crown to sole direction.

Clause 43. The golf club head of clause 8, wherein a perimeter of each flexure shape recess comprises a plurality of concave and convex edges relative to a center of the flexure shape recess.

Clause 44. The golf club head of clause 11, wherein the major end nodule comprises a convex edge, the minor end nodule comprises a convex edge, and the narrowed portion comprises at least one concave edge.

Clause 45. The golf club head of clause 8, wherein the plurality of flexure shape recesses are positioned on a faceplate region selected from the group consisting of a center region, a toe region, a heel region, a top region, a bottom region, a high-toe region, a low-toe region, a high-heel region, and a low-heel region.

Clause 46. The golf club head of clause 8, wherein the faceplate comprising the plurality of land portions and the plurality of flexure shape recesses is formed by a forging process.

Clause 47. A golf club head comprising: a crown; a sole; a toe; a heel; a faceplate comprising a lattice, the lattice comprises a plurality of land portions that form a plurality of flexure shape recesses; each flexure shape recess comprises: a major end nodule; a minor end nodule; and a narrowed portion connecting the major end nodule and the minor end nodule; wherein the major end nodule comprises a circular shape with a major diameter; wherein the minor end nodule comprises a circular shape with a minor diameter; wherein the major diameter is larger than the minor diameter; wherein the major end nodule comprises a major end vertex and the minor end nodule comprises a minor end vertex; wherein a centerline extends through the flexure shape recess intersecting the major end vertex and the minor end vertex; wherein the narrowed end nodule comprises at least one nadir vertex, the nadir vertex being defined as a vertex located closest to the centerline; and wherein the plurality of flexure shape recesses are separate and not connected with each other.

Clause 48. The golf club head of clause 15, wherein the plurality of flexure shape recesses are oriented in a plurality of linear rows.

Clause 49. The golf club head of clause 16, wherein the plurality of linear rows are oriented in a direction selected from the group consisting of a low-toe to high-heel direction, a low-heel to high-toe direction, a heel to toe direction, and a crown to sole direction.

Clause 50. The golf club head of clause 15, wherein the plurality of flexure shape recesses are positioned on a faceplate region selected from the group consisting of a center region, a toe region, a heel region, a top region, a bottom region, a high-toe region, a low-toe region, a high-heel region, and a low-heel region.

Clause 51. The golf club head of clause 15, wherein the narrowed portion defines a concave portion relative to the centerline, and the major end nodule and the minor end nodule define convex portions relative to the centerline.

Clause 52. The golf club head of clause 15, wherein the faceplate comprising the plurality of land portions and the plurality of flexure shape recesses is formed by a forging process.

Various features and advantages of the disclosure are set forth in the following claims.

What is claimed is:

1. A golf club head comprising:

a crown; a sole; a toe; a heel;

a faceplate comprising a lattice, the lattice comprises a plurality of land portions that form a plurality of flexure shape recesses;

each flexure shape recess comprises:

a major end nodule;

a minor end nodule; and a narrowed portion connecting the major end nodule and the minor end nodule;

wherein the major end nodule comprises a circular shape with a major diameter;

wherein the minor end nodule comprises a circular shape with a minor diameter;

wherein the major diameter is larger than the minor diameter; and wherein the plurality of flexure shape recesses are separate and not connected with each other.

2. The golf club head of claim 1, wherein the plurality of flexure shape recesses are oriented in a plurality of linear rows.

3. The golf club head of claim 2, wherein the plurality of linear rows are oriented in a direction selected from the group consisting of a low-toe to high-heel direction, a low-heel to high-toe direction, a heel to toe direction, and a crown to sole direction.

4. The golf club head of claim 1, wherein a perimeter of each flexure shape recess comprises a plurality of concave and convex edges relative to a center of the flexure shape recess.

5. The golf club head of claim 4, wherein the major end nodule comprises a convex edge, the minor end nodule comprises a convex edge, and the narrowed portion comprises at least one concave edge.

6. The golf club head of claim 1, wherein the plurality of flexure shape recesses are positioned on a faceplate region selected from the group consisting of a center region, a toe region, a heel region, a top region, a bottom region, a high-toe region, a low-toe region, a high-heel region, and a low-heel region.

7. The golf club head of claim 1, wherein the faceplate comprising the plurality of land portions and the plurality of flexure shape recesses is formed by a forging process.

8. A golf club head comprising:
- a crown; a sole; a toe; a heel;
- a faceplate comprising a lattice, the lattice comprises a plurality of land portions that form a plurality of flexure shape recesses;
- each flexure shape recess comprises:
  - a major end nodule;
  - a minor end nodule; and
  - a narrowed portion connecting the major end nodule and the minor end nodule;
- wherein the major end nodule comprises a circular shape with a major diameter;
- wherein the minor end nodule comprises a circular shape with a minor diameter;
- wherein the major diameter is larger than the minor diameter;
- wherein a centerline extends through the flexure shape recess intersecting the major end nodule and the minor end nodule;
- wherein the narrowed portion defines a concave portion of the flexure shape recess relative to the centerline; and
- wherein the plurality of flexure shape recesses are separate and not connected with each other.

9. The golf club head of claim 8, wherein the plurality of flexure shape recesses are oriented in a plurality of linear rows.

10. The golf club head of claim 9, wherein the plurality of linear rows are oriented in a direction selected from the group consisting of a low-toe to high-heel direction, a low-heel to high-toe direction, a heel to toe direction, and a crown to sole direction.

11. The golf club head of claim 8, wherein a perimeter of each flexure shape recess comprises a plurality of concave and convex edges relative to a center of the flexure shape recess.

12. The golf club head of claim 11, wherein the major end nodule comprises a convex edge, the minor end nodule comprises a convex edge, and the narrowed portion comprises at least one concave edge.

13. The golf club head of claim 8, wherein the plurality of flexure shape recesses are positioned on a faceplate region selected from the group consisting of a center region, a toe region, a heel region, a top region, a bottom region, a high-toe region, a low-toe region, a high-heel region, and a low-heel region.

14. The golf club head of claim 8, wherein the faceplate comprising the plurality of land portions and the plurality of flexure shape recesses is formed by a forging process.

15. A golf club head comprising:
- a crown; a sole; a toe; a heel;
- a faceplate comprising a lattice, the lattice comprises a plurality of land portions that form a plurality of flexure shape recesses;
- each flexure shape recess comprises:
  - a major end nodule;
  - a minor end nodule; and
  - a narrowed portion connecting the major end nodule and the minor end nodule;
- wherein the major end nodule comprises a circular shape with a major diameter;
- wherein the minor end nodule comprises a circular shape with a minor diameter;
- wherein the major diameter is larger than the minor diameter;
- wherein the major end nodule comprises a major end vertex and the minor end nodule comprises a minor end vertex;
- wherein a centerline extends through the flexure shape recess intersecting the major end vertex and the minor end vertex;
- wherein the narrowed portion comprises at least one nadir vertex, the nadir vertex being defined as a vertex located closest to the centerline; and
- wherein the plurality of flexure shape recesses are separate and not connected with each other.

16. The golf club head of claim 15, wherein the plurality of flexure shape recesses are oriented in a plurality of linear rows.

17. The golf club head of claim 16, wherein the plurality of linear rows are oriented in a direction selected from the group consisting of a low-toe to high-heel direction, a low-heel to high-toe direction, a heel to toe direction, and a crown to sole direction.

18. The golf club head of claim 15, wherein the plurality of flexure shape recesses are positioned on a faceplate region selected from the group consisting of a center region, a toe region, a heel region, a top region, a bottom region, a high-toe region, a low-toe region, a high-heel region, and a low-heel region.

19. The golf club head of claim 15, wherein the narrowed portion defines a concave portion relative to the centerline, and the major end nodule and the minor end nodule define convex portions relative to the centerline.

20. The golf club head of claim 15, wherein the faceplate comprising the plurality of land portions and the plurality of flexure shape recesses is formed by a forging process.

* * * * *